US007247413B2

(12) United States Patent
Kido et al.

(10) Patent No.: US 7,247,413 B2
(45) Date of Patent: Jul. 24, 2007

(54) ELECTROSTATIC LATENT-IMAGE DEVELOPING TONER

(75) Inventors: Kenichi Kido, Hino (JP); Junji Machida, Toyonaka (JP); Masahiro Anno, Hachioji (JP); Atsushi Yamamoto, Kawanishi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 316 days.

(21) Appl. No.: 10/820,061

(22) Filed: Apr. 8, 2004

(65) Prior Publication Data

US 2005/0074685 A1 Apr. 7, 2005

(30) Foreign Application Priority Data

Sep. 22, 2003 (JP) ..... 2003-329445
Sep. 22, 2003 (JP) ..... 2003-329451
Sep. 22, 2003 (JP) ..... 2003-329453
Sep. 22, 2003 (JP) ..... 2003-329455
Sep. 22, 2003 (JP) ..... 2003-329460

(51) Int. Cl.
*G03G 9/093* (2006.01)

(52) U.S. Cl. ..... 430/110.2; 430/109.4

(58) Field of Classification Search ..... 430/110.2, 430/109.4
See application file for complete search history.

(56) References Cited

U.S. PATENT DOCUMENTS 3,893,932 A * 7/1975 Azar et al. ..... 430/110.2
4,954,412 A * 9/1990 Breton et al. ..... 430/137.12
5,529,876 A 6/1996 Sasaki et al.
6,130,290 A * 10/2000 Troy et al. ..... 525/63
6,790,577 B1 * 9/2004 Nakamura ..... 430/109.3

FOREIGN PATENT DOCUMENTS

| | | |
|---|---|---|
| JP | 60-003647 | 1/1985 |
| JP | 04-363330 | 12/1992 |
| JP | 06-175389 | 6/1994 |
| JP | 06-234930 | 8/1994 |
| JP | 08-194396 | 7/1996 |
| JP | 11-305479 | 11/1999 |
| JP | 2002-006539 | 1/2002 |
| JP | 2002-229248 A | 8/2002 |
| JP | 2002-229251 A | 8/2002 |
| JP | 2002-341584 A | 11/2002 |
| JP | 2002-341585 | 11/2002 |
| JP | 2002-341586 A | 11/2002 |
| JP | 2005-024784 | 1/2005 |

* cited by examiner

*Primary Examiner*—John L Goodrow
(74) *Attorney, Agent, or Firm*—Buchanan Ingersoll & Rooney PC

(57) ABSTRACT

An electrostatic latent-image developing toner comprising:
a core particle and a shell layer formed on an outer portion thereof,
wherein the shell layer comprises a crystalline polyester resin having a softening point from 60 to 120° C. at 70 to 100% by weight of the entire shell-layer constituent resin, and an image-forming method using the toner.

20 Claims, 2 Drawing Sheets

ELECTROSTATIC LATENT-IMAGE DEVELOPING TONER

This application is based on application(s) No. 2003-329445, 2003-329451, 2003-329453, 2003-329455 and 2003-329460 filed in Japan, the contents of which are hereby incorporated by reference.

BACKGROUND OF THE INVENTION

1. Field of the Invention

The present invention relates to an electrostatic latent-image developing toner.

2. Description of the Related Art

The electrostatic latent-image developing toner, which is used in an image-forming apparatus of an electrophotographic system, contains at least a resin and a colorant, and normally, a wax is added thereto in order to prevent high-temperature offset as well as low-temperature offset. The high-temperature offset refers to a phenomenon in which inter-toner aggregating force of fused toner to form a toner image is weakened due to overheat and one portion of the toner image is transferred onto a fixing roller, with the result that the toner adheres to the next recording medium (paper or the like). The low-temperature offset refers to a phenomenon in which heat energy to be used for fusing toner becomes insufficient to cause unfused toner in the vicinity of a recording medium with only the toner in the vicinity of the fixing roller being fused so that the adhesivity between the fixing roller and the toner becomes greater than the adhesivity between the toner and the recording medium to cause the toner image to adhere to the fixing roller, with the result that the subsequent toner adheres to the next recording medium. When the colorant and the wax are exposed to the surface of toner particles, the colorant and the wax tend to be transferred onto members such as a photosensitive member and a developing roller that contact the toner particles to cause image noise such as filming, which forms a main problem with the toner.

With respect to the toner, there have been demands for a low-temperature fixing property and a heat-resistant storing property, which are contradictory properties. In other words, the low-temperature fixing property is a property that allows a toner image to be sufficiently fixed on a recording medium at a comparatively low temperature, and in order to improve such a low-temperature fixing property, a method for using a resin having a comparatively low melting temperature as the toner constituent resin is proposed. However, the application of such a method results in a decrease in the glass transition point of the resin and the subsequent degradation in the heat-resistant storing property to cause aggregation at the time of storage at comparatively high temperatures. This also causes degradation in the image storing property. The image storing property is related to the storing property of the recording medium bearing an image that has been subjected to electrophotographic processes. In the case when the image storing property deteriorates, upon storing superposed images (in particular, double sided copies) at a high temperature (for example, 50° C.), the recording media adhere to each other, causing image separation when detached from each other.

With respect to toner particles having a core-shell shell structure in which a shell layer is formed on the surface of core particles so as to achieve both of the low-temperature fixing property and the heat-resistant storing property, a technique has been proposed (see Japanes Patent Application Laid-Open No. 2002-229251 and Japanese Patent Application Laid-Open No. 2002-229248) in which a low-softening-point resin is used as a core material, while a high-softening-point resin is used as a shell material. This method tries to improve the low-temperature fixing property by lowering the softening point of the core to decrease the viscosity, while improving the heat-resistant storing property by using a high-softening-point substance as the shell. With respect to the high-softening-point resin, generally known amorphous resins may be used. With this method, when the colorant and the wax are added to the core particles, the colorant and the wax are not exposed to the surface of toner particles because of the existence of the shell layer, thereby making it possible to effectively prevent image noise such as filming. In this method, however, the existence of the shell layer makes the core difficult to dissolve, failing to provide a sufficient low-temperature fixing property. Since the time required for the wax to elute to the surface of toner particles is too long, it is not possible to sufficiently prevent high-temperature offset. The resulting problem is that the fixing temperature range (non-offset temperature width) in which neither low-temperature offset nor high-temperature offset takes place is narrowed. The toner particles having the core-shell structure are generally obtained by adhering/fusing shell-use resin particles onto the surface of core particles in an aqueous medium; however, since the surface of the toner particles is formed by the high-softening-point shell-use resin particles, it becomes difficult to increase the fusing property of the toner particles and the degree of roundness in the entire toner particles.

In order to improve the low-temperature fixing property of the toner particles of the core-shell structure, a technique has been proposed (Japanese Patent Application Laid-Open No. 2002-341586) in which 2 to 15% by weight of crystalline resin is added to the shell layer. However, from the viewpoint of balance with the heat-resistant storing property, this structure has failed to exert a sufficient low-temperature fixing property.

It has been known that, upon transferring a toner image from an intermediate transferring member or a photosensitive member onto a recording medium to be fixed thereon, a simultaneous transferring/fixing system, which simultaneously carries out a transferring process and a fixing process, is preferably used from the viewpoints of a small size of the device and an improvement of the transferring efficiency (see Japanese Patent Application Laid-Open No. 2002-341584). However, the conventional toner particles fail to exert a sufficient low-temperature fixing property from the viewpoint of ensuring proper balance between the low-temperature fixing property and the heat-resistant storing property, and consequently fail to effectively reduce the fixing temperature even when applied to the above-mentioned simultaneous transferring/fixing system. For this reason, repeated image-forming processes cause a roughened surface of the intermediate transferring member, resulting in a problem of gloss irregularities.

In the case of a mono-component developing system in which, upon developing a latent image on the photosensitive member, the toner particles are allowed to pass through a gap between a developing member and a regulating member, such as a sleeve and a roller, to be friction-charged, the toner particles need to have an anti-braking property against mechanical stress. However, the above-mentioned toner particles having a core-shell structure are susceptible to separation of the shell layer, and have a problem with anti-breaking property. In the case when the anti-breaking property of the toner particles is poor, the toner particles are broken during developing processes to cause a widened charge-quantity distribution and the subsequent pollution inside the actual machine, as well as toner adhesion to the regulating blade and the subsequent longitudinal scratch lines.

SUMMARY OF THE INVENTION

The present invention is to provide an electrostatic latent-image developing toner that has superior low-temperature fixing property and heat-resistant storing property.

Another objective of the present invention is to provide an image-forming method which can form an image having sufficient fixing strength even when a toner having a superior heat-resistant storing property is adopted, and provide a comparatively wide fixing temperature range (non-offset temperature width) in which neither low-temperature offset nor high-temperature offset takes place.

The above object can be achieved by an electrostatic latent-image developing toner comprising:

a core particle and a shell layer formed on an outer portion thereof, wherein the shell layer comprises a crystalline polyester resin having a softening point from 60 to 120° C. at 70 to 100% by weight of the entire shell-layer constituent resin, and an image-forming method using the toner.

DETAILED DESCRIPTION OF THE INVENTION

Figure 1:
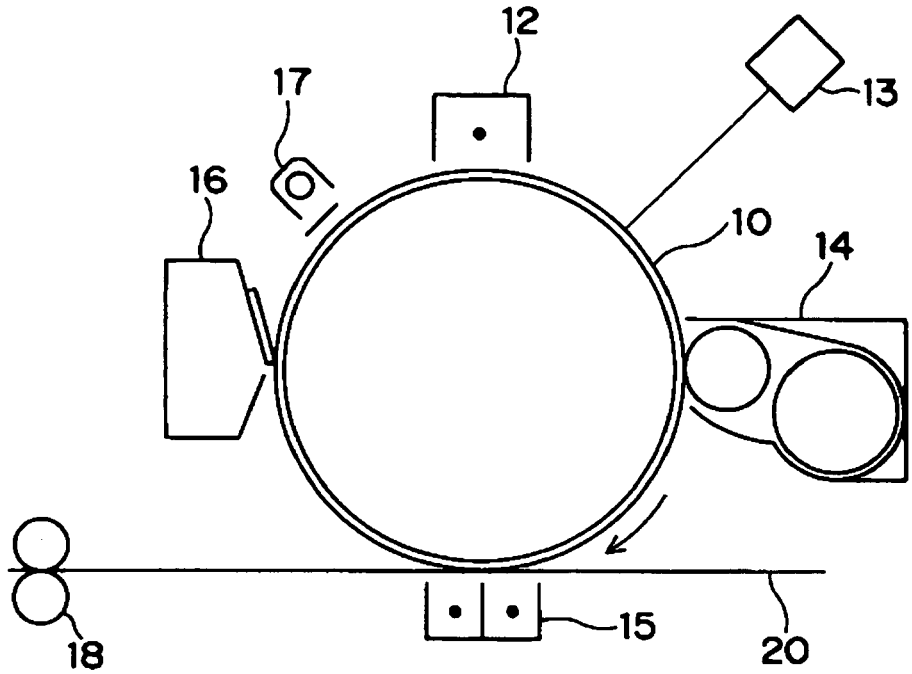
FIG. 1 is a schematic block diagram that shows one example of an image-forming apparatus using an image-forming method of the present invention.

The toner of the invention for developing an electrostatic latent image is characterized by comprising:

a core particle and a shell layer formed on an outer portion thereof, wherein the shell layer comprises a crystalline polyester resin having a softening point from 60 to 120° C. at 70 to 100% by weight of the entire shell-layer constituent resin, and an image-forming method is characterized by using the above toner.

The toner of the present invention have superior properties in both of the low-temperature fixing property and heat-resistant storing property. Therefore, even when applied to the simultaneous transferring/fixing system, it becomes possible to obtain images free from gloss irregularities for a comparatively long time, and also to provide a comparatively wide non-offset temperature width. Even when applied to a mono-component developing system, the present invention toner provides superior anti-breaking property, and is also superior in the anti-filming property and image-storing property.

The image-forming method of the present invention makes it possible to form an image having sufficient fixing strength even when a toner having a superior heat-resistant storing property is used. It becomes possible to exert sufficient fixing strength even when a toner having a superior heat-resistant storing property is used, so that an image without image noise due to filming can be formed, with a wider fixing temperature range (non-offset temperature width) in which neither low-temperature offset nor high-temperature offset takes place; therefore, it is possible to prevent pollution inside the actual machine and image noise due to toner adhesion. It becomes possible to provide a superior image storing property.

The image-forming method of the present invention makes it possible to provide an image free from gloss irregularities even when a simultaneous transferring/fixing system is adopted. Even when the simultaneous transferring/fixing system and a toner having a superior heat-resistant storing property are adopted, it becomes possible to form an image that has sufficient fixing strength and is free from gloss irregularities, and also to provide a comparatively wide fixing temperature range (non-offset temperature width) in which neither low-temperature offset nor high-temperature offset takes place.

(Crystalline)

In the present specification, the term "crystalline" in the resin means that the ratio (softening point/melting point) of the softening point to the melting point of the resin is not less than 0.9 to not more than 1.1. In the present invention, the ratio depends on the monomer composition of the resin, and is hardly dependent on conditions, such as a cooling rate, at the time of synthesizing the resin. Those resins having the ratio out of the above-mentioned range are defined as "amorphous."

With respect to the softening point, melting point and glass transition point, the present invention uses values respectively obtained through the following methods. However, those values need not be measured by the following methods, and any device may be used as long as it carries out measurements based upon the same principle and rules as the following methods.

(Softening Point)

A sample to be measured (1.0 g) was weighed, and a flow tester (CFT-500: made by Shimadzu Corp) was used. Measurements were made under conditions of the application of a die having a size of h 1.0 mm×ϕ1.0 mm, a temperature-rise rate of 3.0° C./min, a pre-heating time of 180 seconds, a load of 30 kg and a measuring temperature range of 60 to 180° C., and the temperature at the time of the 1/2 flow of the above-mentioned sample was defined as softening point.

(Melting Point)

A differential scanning calorimeter (DSC 210: made by Seiko Instruments Inc.) was used. A sample to be measured was heated to 200° C., and the sample was cooled from this temperature to 0° C. at a temperature-drop rate of 10° C./min, and then subjected to measurements at a temperature-rise rate of 10° C./min, then the maximum peak temperature of heat of fusion was found.

(Glass Transition Point)

In the above-mentioned measurements of the melting point, an intersection between the extension line of a base line indicating not more than the maximum peak temperature and the tangent indicating the maximum gradient from the rising portion to the top of the peak was found, and the temperature at this point was defined as the glass transition point.

The electrostatic latent-image developing toner of the present invention contains toner particles of a core-shell structure constituted by a core particle and a shell layer.

The electrostatic latent-image developing toner of the present invention may have an intermediate layer between the core particle and the shell layer.

In the present invention, the core particle may have any structure, and, for example, may have a structure formed by allowing at least resin particles to aggregate/fuse to one another, or may be formed by one resin particle. From the viewpoints of sharpness of particle size distribution and degree of roundness and reproducibility of the core particle, more specifically, the toner particle, the former structure is preferably adopted.

The core particles may comprise specific wax and colorant.

In the present specification, the term "aggregation" is used as the concept that at least one group of particles such as resin particles, wax particles and colorant particles are simply allowed to adhere to one another. Although constituent particles are made in contact with one another through "aggregation," bonds, which are made through flux between the resin particles, are not formed; thus, so-called hetero-aggregated particles (group) are formed. The particle group, formed through such "aggregation," is referred to as "aggregated particles."

The term "fusion" is used as the concept that a bond is formed through melting between resin particles at least one portion on the interface of the respective constituent particles in the aggregated particles to provide one particle that forms a unit in use and handling. The group of particles that are subjected to such "fusion" are referred to as "fused particles."

The term "aggregating/fusing" indicates the fact that aggregating and fusing processes are carried out simultaneously or step by step, or the action that allows the aggregating and fusing processes to take place simultaneously or step by step.

<Core Particles Containing Resin Particles>

The kinds of resin to be used for forming the structure containing at least resin particles are not particularly limited, as long as the surface of the core particle is capable of holding a shell layer which will be described later, and for example, resins having a polar group are preferably used. Specific examples thereof include: polyester resin; polyurethane; polyamide resin; furan resin; epoxy resin; xylene resin; polyvinyl butyral; terpene resin; chroman indene resin; petroleum resin; phenolic resin; natural modified phenolic resin; natural modified maleic acid resin; acrylic resin; methacrylic resin; and polyvinyl acetate. Styrene-based copolymers, such as styrene and monopolymer of a substitution product thereof like polystyrene, poly-p-chlorostyrene and polyvinyl toluene; styrene-p-chlorostyrene copolymer, styrene-vinyl toluene copolymer, styrene-vinyl naphthalene copolymer, styrene-acrylic acid ester copolymer, styrene-methacrylic acid ester copolymer, styrene-α-methyl chloromethacrylate copolymer, styrene-acrylonitrile copolymer, styrene-vinylmethyl ether copolymer, styrene-vinylethyl ether copolymer, styrene-vinyl methyl ketone copolymer, styrene-butadiene copolymer, styrene-isoprene copolymer and styrene-acrylonitrile-indene copolymer, are preferably used by graft-polymerizing polyester therewith. Among the above-mentioned resins, the polyester resin is most preferably used from the viewpoints of a bonding property to the shell layer, toughness, a low-temperature fixing property, and transparency as well as a color-developing property in the image.

The polyester resin can be produced by polycondensing a polyhydroxy alcohol component and a polycarboxylic acid component through a heating process under a reduced pressure and/or the presence of a catalyst, if necessary.

With respect to the polyhydroxy alcohol components, specific examples thereof include: diols such as polyoxypropylene(2,2)-2,2-bis(4-hydroxyphenyl)propane, polyoxypropylene(3,3)-2,2-bis(4-hydroxyphenyl)propane, polyoxyethylene(2,0)-2,2-bis(4-hydroxyphenyl)propane, polyoxypropylene(2,0)-polyoxyethylene(2,0)-2,2- bis(4-hydroxyphenyl)propane, polyoxypropylene(2,0)-polyoxyethylene (2,0)-2,2-bis(4-hydroxyphenyl) propane; ethylene glycol, diethylene glycol, triethylene glycol, polyethylene glycol, propylene glycol, dipropylene glycol, isopentyl glycol, hydrogenated bisphenol A, 1,3-butane diol, 1,4-butane diol, neopentyl glycol, xylylene glycol, 1,4-cyclohexane dimethanol, glycerin, trimethylol ethane, trimethylol propane, pentaerythritol, bis-(β-hydroxyethyl)terephthalate, tris-(β-hydroxyethyl)isocyanurate and 2,2,4-trimethylol pentane-1,3-diol, and these compounds may be used alone, or two or more kinds of these may be used in combination. With respect to the hydroxy carboxylic acid component, for example, p-oxybenzoic acid, vanillinic acid, dimethylol propionic acid, malic acid, tartaric acid, 5-hydroxyisophthalic acid and the like may be added.

With respect to the polycarboxylic acid components, specific examples thereof include: malonic acid, succinic acid, glutaric acid, dimer acid, phthalic acid, isophthalic acid, terephthalic acid, isophthalic acid dimethyl ester, terephthalic acid dimethyl ester, terephthalic acid monomethyl ester, tetrahydroterephthalic acid, methyltetrahydrophthalic acid, hexahydrophthalic acid, dimethyltetrahydrophthalic acid, endomethylene hexahydrophthalic acid, fumaric acid, naphthalene tetracarboxylic acid, diphenolic acid, trimellitic acid, pyromellitic acid, trimethine acid, cyclopentane dicarboxylic acid, 3,3',4,4'-benzophenone tetracarboxylic acid, 1,2,3,4-butane tetracarboxylic acid, 2,2-bis-(4-carboxyphenyl)propane, diimide carboxylic acid derived from trimellitic anhydride and 4,4-diaminophenyl methane, tris-(β-carboxyethyl)isocyanurate, polyimide carboxylic acid containing an isocyanurate ring, polyimide carboxylic acid containing an isocyanate ring derived from a trimer reaction product of tolylenediisocyanate, xylylenediisocyanate or isophoronediisocyanate and trimellitic anhydride, and acid anhydrides, acid chlorides and lower alkyl esters (1 to 3 carbon atoms) of these, and these materials may be used alone or two or more kinds of these may be mixed and used.

A urea modified polyester resin may be used as the polyester resin. By using the urea modified polyester resin, it becomes possible to provide a superior heat-resistant storing property and a wider non-offset temperature width. Although the detailed mechanisms of such effects have not been clarified, it is considered that the effects are obtained based upon the following functions of the urea modified polyester resin. By urea-modifying polyester (prepolymer), it is possible to impart elasticity to the resin. Consequently, it becomes possible to prevent aggregation due to heat (heat-resistant storing property) and also to improve the release property from the fixing roller (anti-offset property) by the subsequent effect.

The urea-modified polyester resin is formed by chain-extending the polyester prepolymer through at least a urea bond.

The urea-modified polyester resin can be synthesized by using, for example, the following method.

First, after having synthesized a polyester prepolymer, the prepolymer is allowed to react with a polyhydroxy isocyanate compound so that an isocyanate group is inserted thereto to prepare a prepolymer containing an isocyanate group. For example, when the terminal group of the polyester prepolymer is a hydroxyl group, a urethane bond is formed through the reaction with the polyhydroxy isocyanate compound so that a prepolymer containing an isocyanate group to which the isocyanate group is inserted by the urethane bond is obtained. For example, when the terminal group of the polyester prepolymer is a carboxylic group, the reaction with the polyisocyanate compound generates $CO_2$ to form an amide bond so that a prepolymer containing an isocyanate group to which the isocyanate group is inserted by the amide bond is obtained.

By allowing the prepolymer containing an isocyanate group to react with a polyhydroxy amino compound so as to extend the chain thereof, a urea-modified polyester resin is obtained. A urea bond is formed through the reaction between the prepolymer containing an isocyanate group and the polyhydroxy amino compound, and the prepolymer containing an isocyanate group is chain-extended by the urea bond through the polyhydroxy amino compound so that a urea-modified polyester resin is obtained.

The polyester prepolymer, constituting the urea-modified polyester resin, is synthesized by heating the polyhydroxy alcohol component and the polycarboxylic acid component under a reduced pressure atmosphere, under the presence of a catalyst and/or under a nitrogen atmosphere, if necessary, to undergo a polycondensation reaction.

Specific examples of the polyhydroxy isocyanate compound used for introducing the isocyanate group include: aliphatic polyisocyanates such as tetramethylene diisocyanate, hexamethylene diisocyanate and 2,6-diisocyanate methylcaproate, alicyclic polyisocyanates such as isophorone diisocyanate and cyclohexyl methane diisocyanate, aromatic diisocyanates such as tolylenediisocyanate, diphenylmethane diisocyanate, and aromatic diisocyanates such as α,α,α',α'-tetramethylxylylene diisocyanate. Among these, alicyclic polyisocyanate is preferably used. These may be used alone or in combination.

With respect to the polyhydroxy amino compound used for chain-extending, specific examples thereof include diamines like aromatic diamines, such as phenylene diamine, diethyltoluene diamine and 4,4' diaminodiphenyl methane, alicyclic diamines such as 4,4'-diamino-3,3' dimethyldicyclohexyl methane, diamine cyclohexane and isophorone diamine, and aliphatic diamines such as ethylene diamine, tetramethylene diamine and hexamethylene diamine. With respect to trivalent or more polyamines, examples thereof include diethylene triamine and triethylene tetramine. Among these, alicyclic diamine is preferably used. These may be used alone or in combination.

The softening point of the urea-modified polyester resin is preferably set from 80 to 130° C., preferably from 95 to 120° C.

The content of the urea-modified polyester resin is not particularly limited, as long as the effects of the present invention are obtained. It is preferably set in a range from 2 to 40% by weight, preferably from 4 to 30% by weight, with respect to the total amount of the core-particle constituent resin.

The polyester resin may have a crystalline property or an amorphous property. With respect to the polyester resin, two kinds or more polyester resins having mutually different compositions may be used, and in this case, a crystalline polyester resin and an amorphous polyester resin may be used in combination.

Irrespective of the presence or absence of the crystalline property of the polyester resin, the softening point of the resin is preferably set in a range from 80 to 130° C., preferably from 95 to 120° C., from the viewpoints of a low-temperature fixing property. When two or more kinds of polyester resins are used, it is preferable to set the softening points of any of the resins in the above-mentioned range.

With respect to the manufacturing method of core particles, for example, any of toner-particle manufacturing methods, such as so-called suspension polymerization method, emulsion polymerization method, dissolution suspension method and coagulation method, may be used, and not particularly limited, core particles, manufactured through a known manufacturing method, may be used.

In the case when the core particles are formed by aggregating/fusing resin particles and the resin particles are made from polyester resin, the core particles are normally obtained by aggregating/fusing polyester resin particles obtained through the dissolution suspension method by using the coagulation method.

More specifically, first, a desired polyester resin is dissolved in an organic solvent, and the resulting solution is granulated in an aqueous solvent while being stirred and subject to high-speed shear by using a mixing/stirring device such as a homogenizer, and heated to remove the organic solvent; thus, resin particles having a weight-average particle size of 50 to 300 nm are obtained.

With respect to the organic solvent, those solvents which are capable of dissolving a polyester resin and insoluble to water can be used, and depending on constituent components of the polyester, selection is normally made from, for example, the following materials: hydrocarbons such as toluene, xylene and hexane, halogenated hydrocarbons such as methylene chloride, chloroform and dichloroethane, alcohols such as ethanol, butanol, benzyl alcohol ether and tetrahydrofran, esters such as ether, methyl acetate, ethyl acetate, butyl acetate and isopropyl acetate and ketones such as acetone, methylethyl ketone, diisobutyl ketone, cyclohexane and methylcyclohexanone. Although not particularly limited, the weight ratio of the resin and the organic solvent is set in a range from 10/90 to 80/20, preferably from 30/70 to 70/30, more preferably 40/60 to 60/40, from the viewpoints of easiness in forming resin particles and improvement in the yield of the resin particles obtained through the succeeding aggregating process.

A known surfactant may be appropriately added to the aqueous solvent so as to stabilize the dispersion.

The removing process of the organic solvent may be carried out under reduced pressure.

The resin particles may be obtained through a so-called flux (fusion) suspension method, which will be described later.

After resin particles have been obtained, at least resin particles are allowed to aggregate/fuse to one another through a salting-out process in an aqueous medium to prepare core particles having a volume-average particle size of 3.0 to 8.0 μm. To the aqueous medium, toner constituent materials such as colorant particles and wax particles are added, and allowed to aggregate/fuse to one another together with the resin particles. Charge controlling agent particles may be added thereto as the toner constituent materials. Not limited to being contained in only the core particles, these toner constituent may be added in the succeeding shell-layer forming process so as to be contained in the shell layer.

The salting-out treatment, which is described in various documents and books concerning colloid as well as in Chapter 6 and thereafter of "Chemistry of Polymer Latex" written by Soichi Muroi, (published by Polymer Publishing Society) in detail, is a method in which electric double layers of dispersed particles in a solvent are compressed so as to allow the particles to aggregate with one another. In the present invention, with respect to a flocculant that is normally used so as to carry out the "salting-out" process, in addition to a surfactant having a reversed polarity to the polarity of a polar functional group of the resin particles as well as to the polarity of a surfactant to be used as a dispersion solution of colorant particles to be aggregated together with the resin particle dispersion solution and the resin particles, a divalent or more inorganic metal salt is preferably used. In general, the higher the number of valence, the higher the aggregating force becomes; therefore, the flocculant is properly selected by taking the aggregating speed and the stability of the manufacturing process into consideration. Specific examples of the flocculant include: metal salts, such as calcium chloride, calcium nitrate, barium chloride, magnesium chloride, zinc chloride, aluminum chloride and aluminum sulfate; and inorganic metal salt polymers, such as aluminum polychloride, aluminum polyhydroxide and calcium polysulfide.

In general, upon adding the flocculant, the temperature of the dispersion system is preferably maintained below 40° C. in order to suppress an abrupt aggregation inside the system. When the flocculant is added under a condition exceeding 40° C., an abrupt aggregation tends to occur, making the particle size control difficult, as well as causing a problem of low bulk density of the resulting particles. Thereafter, in general, this is heated to allow the aggregating and fusing processes of the particles to progress simultaneously; thus, fused particles are generated. With respect to the stirring process, conventionally known stirring devices, such as a reaction vessel having paddle blades, anchor blades, triple sweptback blades, max blend blades, double helical blades and the like, may be used, or devices such as a homogenizer, a homomixer and a Henschel mixer may be used. The number of revolutions in the stirring process is preferably set so as to maintain the system in a turbulent flow state.

The particle size growth through the aggregation (salting-out reaction) is comparatively easily controlled by adjusting the pH and the temperature of the dispersion solution. The pH value is not univocally defined since the value varies depending on ZETA potential and equipotential points of the reaction system, as well as on the kinds and amounts of the flocculant to be used, the kinds and amounts of the emulsifying agent and the particle sizes of the target toner; however, for example, in the case when an aluminum-based flocculant is used, the pH value is set in a range of 2 to 6 in order to effectively exert the salting-out function, and in the case of a magnesium-based flocculant, the pH value is set in a range of 7 to 12.

In the same manner as the pH, although not univocally defined, the reaction temperature is preferably set to a condition in which the particle size growth is controlled within a range of 40 to 95° C. At a temperature higher than this range, the shape of the toner particle tends to become virtually a true spherical shape due to the simultaneous progress of the aggregating and fusing processes, failing to provide a sufficient shape-controlling property. The reaction is maintained for at least not less than 10 minutes at a predetermined temperature, preferably for at least not less than 20 minutes, so that core particles having a predetermined particle size are obtained. The reaction temperature lower than Tg of the resin only allows the particles to aggregate, and fails to allow the fusing process to progress, while the reaction temperature higher than Tg allows the aggregating and fusing processes to progress simultaneously. In the case of a slow fusing process, the fusing process may be carried out prior to the formation of the shell layer after the aggregating process, or may be carried out by raising the temperature at the time of forming the shell layer.

In the forming process of the core particles, the heating process may be carried out to a predetermined temperature at a constant temperature-rise rate, or may be carried out step by step. The number of revolutions of the stirring blades may be appropriately adjusted.

With respect to the aggregating rate and particle-size control, these controlling operations are carried out by controlling the reaction temperature and the number of revolutions in the stirring process, while monitoring the aggregating state of the particles inside the system by using a microscope and a particle-size measuring device, until the particles have reached a predetermined particle size. When the particles have reached the predetermined particle size, the forming process of the shell layer may be continuously carried out, or an operation for lowering the aggregating force is carry out so as to stop the particle growth in the system or to delay the growth rate thereof.

With respect to the means for lowering the aggregating force, a means for increasing the stability of the particles or a means for lowering the aggregating function of the flocculant may be used. For example, with respect to the means for increasing the stability of the particles, a method for adjusting the pH of the system toward the stable side (for example, when aggregation is made under an acidic system, an adjustment is carried out from the neutral side toward the alkali side, and when aggregation is made under an alkali system, the adjustment is carried out from the neutral side toward the acidic side), and a method for adding the above-mentioned surfactant and the like may be used. With respect to the means for lowering the aggregating function of the flocculant, metal cations having different numbers of valence may be added so that the aggregating force is greatly lowered due to the antagonistic action thereof. After the aggregating force has been lowered, the system is heated to accelerate the fusing process and also to control the shape toward the spherical-shape side.

With respect to the colorants, various kinds of inorganic pigments, organic pigments and dyes are listed. With respect to the inorganic pigments, conventionally known pigments may be used. Although any pigment may be used, preferable examples of the inorganic pigments are shown below: With respect to the black pigments, examples thereof include: carbon blacks such as Furnace Black, Channel Black, Acetylene Black, Thermal Black and Lamp Black, as well as magnetic powder such as magnetite and ferrite. These inorganic pigments may be used alone or a plurality of these may be used in combination, on demand.

With respect to the organic pigments, those of conventionally known pigments may be used. Any pigment of those may be used; and specific organic pigments are shown below.

With respect to magenta or red pigments, examples thereof include: C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48: 1, C.I. Pigment Red 53: 1, C.I. Pigment Red 57: 1, C.I. Pigment Red 81: 3, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 184, C.I. Pigment Red 185, C.I. Pigment Red 222 and C.I. Pigment Red 238.

With respect to orange or yellow pigments, examples thereof include: C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 74, C.I. Pigment Yellow 93, C.I. Pigment Yellow 94, C.I. Pigment Yellow 97, C.I. Pigment Yellow 138 and C.I. Pigment Yellow 180.

With respect to green or cyan pigments, examples thereof include: C.I. Pigment Blue 15, C.I. Pigment Blue 15: 2, C.I. Pigment Blue 15: 3, C.I. Pigment Blue 16, C.I. Pigment Blue 60 and C.I. Pigment Green 7.

With respect to dyes, examples thereof include: C.I. Solvent Reds 1, 49, 52, 58, 63, 111 and 122; C.I. Solvent Yellows 19, 44, 77, 79, 81, 82, 93, 98, 103, 104, 112 and 162; and C.I. Solvent Blues 25, 36, 60, 70, 93 and 95. A mixture of these may be used.

These organic pigments and dyes may be used alone or a plurality of these may be selected and used in combination, on demand.

These colorants are preferably used as a dispersed matter formed by being dispersed in water in the presence of a known surfactant. The dispersion particle size of the colorant dispersed matter is preferably set to not more than 1 μm, preferably in a range from 30 to 500 nm, more preferably from 30 to 300 nm.

Waxes are also preferably used as a dispersed matter formed by being dispersed in water in the presence of a known surfactant.

The dispersion particle size of the wax dispersed matter is preferably set to not more than 1 μm, preferably in a range from 30 to 500 nm, more preferably from 30 to 300 nm.

With respect to the wax, various known waxes that can be dispersed in water are proposed. Specific examples of the wax include: olefin-based waxes such as low-molecular-weight polyethylene, low-molecular-weight polypropylene, copolymer polyethylene, grafted polyethylene and grafted polypropylene; ester-based waxes having a long-chain aliphatic group such as behenyl behenate, montanate and stearyl stearate; plant-based waxes such as hydrogenated castor oil and carnauba wax; ketones having a long-chain alkyl group such as distearyl ketone; silicone-based waxes having an alkyl group or a phenyl group; higher fatty acid such as stearic acid; higher fatty acid amides such as oleic acid amide and stearic acid amide; long-chain fatty acid alcohols; long-chain fatty acid polyhydroxy alcohols such as pentaerythritol and partial esters thereof; paraffin-based waxes; and Fischer-Tropsch wax.

With respect to preferable waxes to be added to the toner of the present invention, those composed of a crystalline ester compound represented by the following formula (1) (hereinafter, referred to as "specific ester compound") can be proposed.

$$R^1\text{—}(OCO\text{—}R^2)_n \qquad \text{Formula (1)}$$

(in the formula, each of $R^1$ and $R^2$ independently represents a hydrocarbon group having 1 to 40 carbon atoms, which may have a substituent, and n is an integer of 1 to 4.)

In formula (1) representing the specific ester compound, each of $R^1$ and $R^2$ represents a hydrocarbon group that may have a substituent. The hydrocarbon group $R^1$ has 1 to 40 carbon atoms, preferably 1 to 20, more preferably 2 to 5. The hydrocarbon group $R^2$ has 1 to 40 carbon atoms, preferably 16 to 30, more preferably 18 to 26. In formula (1), n is an integer of 1 to 4, preferably 2 to 4, more preferably 3 and 4, most preferably 4. The specific ester compound is preferably synthesized through a dehydration condensing reaction between alcohol and carboxylic acid.

With respect to specific examples of the specific ester compound, the following compounds represented by the respective formulas (1w) to (22w) are proposed:

(1w) $CH_3\text{—}(CH_2)_{12}\text{—}COO\text{—}(CH_2)_{17}\text{—}CH_3$ (2w) $CH_3\text{—}(CH_2)_{18}\text{—}COO\text{—}(CH_2)_{17}\text{—}CH_3$ (3w) $CH_3\text{—}(CH_2)_{20}\text{—}COO\text{—}(CH_2)_{21}\text{—}CH_3$ (4w) $CH_3\text{—}(CH_2)_{14}\text{—}COO\text{—}(CH_2)_{19}\text{—}CH_3$ (5w) $CH_3\text{—}(CH_2)_{20}\text{—}COO\text{—}(CH_2)_6\text{—}O\text{—}CO\text{—}(CH_2)_{20}\text{—}CH_3$ (6w) $CH_3\text{—}(CH_2)_{20}\text{—}COO\text{—}(CH_2)_2\text{—}CH(CH_3)\text{—}CH_2\text{—}O\text{—}CO\text{—}(CH_2)_{20}\text{—}CH_3$ (7w) $CH_3\text{—}(CH_2)_{22}\text{—}COO\text{—}(CH_2)_2\text{—}CH(CH_3)\text{—}CH_2\text{—}O\text{—}CO\text{—}(CH_2)_{22}\text{—}CH_3$ (8w) $CH_3\text{—}(CH_2)_{22}\text{—}COO\text{—}CH_2\text{—}C(CH_3)_2\text{—}CH_2\text{—}O\text{—}CO\text{—}(CH_2)_{22}\text{—}CH_3$ (9w) $CH_3\text{—}(CH_2)_{26}\text{—}COO\text{—}CH_2\text{—}C(CH_3)_2\text{—}CH_2\text{—}O\text{—}CO\text{—}(CH_2)_{26}\text{—}CH_3$ (10w)
$$\begin{array}{l} CH_2\text{—}O\text{—}CO\text{—}(CH_2)_{26}\text{—}CH_3 \\ | \\ CH\text{—}O\text{—}CO\text{—}(CH_2)_{26}\text{—}CH_3 \\ | \\ CH_2\text{—}O\text{—}CO\text{—}(CH_2)_{26}\text{—}CH_3 \end{array}$$

-continued (11w) $CH_2-O-CO-(CH_2)_{22}-CH_3$
$CH-O-CO-(CH_2)_{22}-CH_3$
$CH_2-O-CO-(CH_2)_{22}-CH_3$ (12w) $CH_2-OH$
$CH-O-CO-(CH_2)_{26}-CH_3$
$CH_2-O-CO-(CH_2)_{26}-CH_3$ (13w) $CH_2-OH$
$CH-O-CO-(CH_2)_{22}-CH_3$
$CH_2-O-CO-(CH_2)_{22}-CH_3$ (14w) $CH_2-OH$
$CH-OH$
$CH_2-O-CO-(CH_2)_{26}-CH_3$ (15w) $CH_2-OH$
$CH-OH$
$CH_2-O-CO-(CH_2)_{22}-CH_3$ (16w) $CH_3-(CH_2)_{26}-COO-CH_2-C(CH_3)(CH_2-O-CO-(CH_2)_{26}-CH_3)(CH_2-O-CO-(CH_2)_{26}-CH_3)$ (17w) $CH_3-(CH_2)_{20}-COO-CH_2-C(CH_2CH_3)(CH_2-O-CO-(CH_2)_{20}-CH_3)(CH_2-O-CO-(CH_2)_{20}-CH_3)$ (18w) $CH_3-(CH_2)_{26}-COO-CH_2-C(CH_2-O-CO-(CH_2)_{26}-CH_3)(CH_2-O-CO-(CH_2)_{26}-CH_3)(CH_2-O-CO-(CH_2)_{26}-CH_3)$ (19w) $CH_3-(CH_2)_{20}-COO-CH_2-C(CH_2-O-CO-(CH_2)_{20}-CH_3)(CH_2-O-CO-(CH_2)_{20}-CH_3)(CH_2-O-CO-(CH_2)_{20}-CH_3)$ (20w) $CH_3-(CH_2)_{18}-COO-CH_2-C(CH_2-O-CO-(CH_2)_{18}-CH_3)(CH_2-O-CO-(CH_2)_{18}-CH_3)(CH_2-O-CO-(CH_2)_{18}-CH_3)$ (21w) $CH_3-(CH_2)_{16}-COO-CH_2-C(CH_2-O-CO-(CH_2)_{16}-CH_3)(CH_2-O-CO-(CH_2)_{16}-CH_3)(CH_2-O-CO-(CH_2)_{16}-CH_3)$ (22w) $CH_3-(CH_2)_{20}-COO-CH_2-C(CH_2-O-CO-CH_3)(CH_2-O-CO-CH_3)(CH_2-O-CO-CH_3)$ Among these waxes, those which are preferably used for improving the low-temperature fixing property are waxes having a softening point of 100° C. or lower, preferably in a range from 50 to 100° C., more preferably from 60 to 90° C. The softening point exceeding 100° C. fails to provide sufficient effects for reducing the fixing temperature.

With respect to the charge-controlling agent, desired known charge-controlling agents may be used alone or in combination. In the case when color-toner applicability (the charge-controlling agent is colorless or has a faded color, causing no color-tone problems to the toner) is taken into consideration, as for the positively chargeable agent, quaternary ammonium chlorides are preferably used, and as for the negatively chargeable agent, metal salts and metal complexes between metals such as chromium, zinc and aluminum and acids such as salicylic acid and alkyl salicylic acid, metal salts and metal complexes of benzyl acid, amide compounds, phenol compounds, naphthol compounds, phenol amide compounds and the like are preferably used. These charge-controlling agents may be prepared as a dispersed matter by using a known surfactant and the like, and used together with the above-mentioned colorant and wax.

<Core Particles Formed of Wax and Colorant>

In the present invention, the core particles may be formed of a specific wax as a main component. In this case, the core particles comprises a wax and a colorant and the wax having a polar group is used. Thereby, it becomes possible to desirably ensure a joining (bonding) property to a shell layer which will be described later, and consequently not only to improve the anti-breaking property and anti-filming property of the toner but also to achieve superior fixing strength.

A polar group refers to a substituent having a hetero element. Specific examples of such a polar group include: groups containing an ester bond, an OH group, an amino group, an amide group and a sulfone group.

From the viewpoint of easiness in formation of core particles, those waxes having a polar group which can be dispersed in water are preferably used, and examples of such preferable waxes include ester compounds indicated by the above-mentioned formula (1).

Among those waxes having a polar group, those having a softening point of 50 to 120° C., more preferably 60 to 110° C., are preferably used so as to improve the fixing property. Two or more kinds of those waxes having a polar group may be used in combination, and in this case, softening points of all the waxes are preferably set within the above-mentioned range.

With respect to the waxes having a polar group in the present invention, it is preferable to contain at least one kind of wax having a softening point lower than that of a crystalline polyester resin forming the shell layer, which will be described later. With this arrangement, the wax is allowed to elute smoothly onto the toner particle surface at the time of fixing, making it possible to effectively expand the anti-offsetting range. The above-mentioned wax softening point is preferably set in a range from 50 to 120° C., preferably from 60 to 110° C. In the case when the shell layer contains two or more kinds of crystalline polyester resins, at least one kind of wax having a softening point lower than the highest softening point of the crystalline polyester resins is preferably contained.

In order to further expand the anti-offsetting range, the core particles preferably contain another wax (hereinafter, referred to as "another wax") that contains no polar group, in addition to the wax having a polar group. Specific examples of "another wax" include olefin-based waxes such as low-molecular weight polyethylene and low-molecular weight polypropylene.

Although not particularly limited, the softening point of "another wax" is preferably set in a range from 70 to 130° C., preferably from 80 to 120° C., the lower limit of which is determined from the viewpoint of proper image storing property, with the higher limit thereof being determined from the viewpoint of fixing strength and easiness in elution.

The content of "another wax" in the core particles is preferably set to not more than 60% by weight, preferably in a range from 30 to 55% by weight, with respect to the wax having a polar group. When the content of "another wax" is too great, the anti-breaking property and the anti-filming property of the toner deteriorate, failing to provide sufficient fixing strength.

In the present invention, the above-mentioned wax is used in such a manner that the wax content (total content of the wax having a polar group and another wax) in the resulting toner particles is set in a range from 3 to 50% by weight, preferably from 5 to 40% by weight, with respect to the toner particles.

With respect to the colorant constituting the core particles, the above-mentioned various inorganic pigments, organic pigments and dyes may be used.

The content of the colorant in the core particles is not particularly limited, as long as a desired image density is obtained, and is set in a range from 3 to 15% by weight, preferably from 5 to 10% by weight, with respect to the total weight of the toner (or in the toner particles).

The core particles may be manufactured by any method as long as the core particles are made from the above-mentioned materials, and manufactured by, for example, allowing at least wax particles having a polar group and colorant particles to aggregate/fuse to one another in an aqueous medium.

The wax-particle dispersion solution is a dispersed matter in which the wax is dispersed in water in the presence of a surfactant. The wax dispersed matter preferably has a dispersed particle size of not more than 1 μm, preferably in a range from 100 to 500 nm.

The colorant-particle dispersion solution is a dispersed matter in which the colorant is dispersed in water in the presence of a surfactant. The colorant dispersed matter preferably has a dispersed particle size of not more than 1 μm, preferably in a range from 100 to 500 nm.

The volume-average particle size of core particles is normally set in a range from 2.0 to 6.0 μm. Other toner constituent materials, such as charge-controlling agent particles, may be added to the aqueous medium, and allowed to aggregate/fuse to one another together with the wax particles and the like. Not limited to being contained in core particles, the charge-controlling agent particles may be added in the succeeding shell-layer forming process, and contained in the shell layer. With respect to the charge-controlling agent, those agents described above may be used alone or in combination.

In the present invention, the shell layer to be formed on the surface of the core particle contains a crystalline polyester resin having a softening point in a range from 60 to 120° C., preferably from 60 to 110° C., at a rate of 70 to 100% by weight, preferably 70 to 95% by weight, with respect to the entire shell-layer constituent resin. In the present invention, the shell layer is allowed to contain a specific amount of a crystalline polyester resin having a specific softening point so that both of the low-temperature fixing property and the heat-resistant storing property can be achieved in a comparatively high level. In other words, the temperature at which the molecular movement of the crystalline polyester resin starts is a temperature higher than the softening point, and is higher than that of an amorphous resin in which the molecular movement starts at a temperature higher than the glass transition point; therefore, by allowing the shell layer to contain such a crystalline polyester resin, it becomes possible to ensure superior heat-resistant storing property. After the start of the molecular movement at a temperature higher than the softening point, the crystalline polyester resin is fused comparatively quickly, and its viscosity drops swiftly. For this reason, in comparison with the amorphous resin in which, after the start of the molecular movement at a temperature higher than the glass transition point, its viscosity is gradually lowered, the crystalline polyester resin is fused quickly at a lower temperature; therefore, by allowing the shell layer to contain such a resin, it becomes possible to effectively improve the low-temperature fixing property. Consequently, the toner of the present invention makes it possible to achieve both of the low-temperature fixing property and the heat-resistant storing property in a comparatively high level.

In particular, it becomes possible to achieve superior fixing strength free from separation with exposed medium on an image and surface separation. This effect is considered to be derived from the facts that the shell layer is allowed to contain a specific crystalline polyester resin whose viscosity is quickly lowered at a rate of not less than a specific amount and that the core particles are mainly composed of a wax, as described above.

In the case when the softening point of the crystalline polyester resin is too high, since the shell layer is not allowed to fuse quickly, it is not possible to carry out a fixing process at a low temperature, and an offset tends to occur. For this reason, the fixing temperature needs to be raised, with the result that this case is susceptible to gloss irregularities in a simultaneous transferring/fixing system. In contrast, in the case when the softening point is too low, the heat-resistant storing property, the image storing property, the anti-breaking property and the anti-filming property tend to deteriorate. Since an excessive fusion takes place in the toner, a high-temperature offset tends to occur, causing a narrowed non-offset temperature width.

When the content of the crystalline polyester resin is too small, it becomes difficult to achieve both of the low-temperature fixing property and the heat-resistant storing property, and even when both of these properties are achieved, since the shell layer is not allowed to fuse quickly, a high-temperature offset tends to occur, resulting in a narrowed non-offset temperature width.

In the present invention, the crystalline polyester resin may be composed of any of the above-mentioned polyhydroxy alcohol components and polycarboxylic acids, as long as it has the above-mentioned "crystalline property"; and normally, it is prepared as a polyester resin formed by polycondensing a dihydroxy alcohol component and a dihydroxy carboxylic component, with at least one of the components being a straight chain compound. In other words, a crystalline polyester resin containing at least a straight-chain dihydroxy alcohol compound and/or a straight-chain dihydroxy carboxylic acid compound as constituent components is used.

The straight-chain compound (that is, straight-chain dihydroxy alcohol compound and/or straight-chain dihydroxy carboxylic acid compound) is a straight-chain aliphatic compound having none of an aromatic ring, a hydro-aromatic ring and an unsaturated bond, and may have an alkyl group having 1 to 2 carbon atoms as a substituent.

Among the dihydroxy alcohol components constituting a crystalline polyester, specific examples of the straight-chain dihydroxy alcohol compounds include: ethylene glycol, diethylene glycol, triethylene glycol, 1,2-propylene glycol, 1,3-propylene glycol, 1,4-butane diol, neopentyl glycol, 1,5-pentane glycol, 1,6-hexane glycol, 1,6-hexane diol, 1,10-decane diol, polyethylene glycol, polypropylene glycol and polytetramethylene glycol.

Among the dihydroxy alcohol components, specific examples of non-straight-chain dihydroxy alcohol compounds except for the above-mentioned straight-chain dihydroxy alcohol compounds include: 1,4-butene diol, 1,4-cyclohexane diolene glycol, 1,4-cyclohexane dimethanol, bisphenol A, bisphenol Z and hydrogenated bisphenol A.

Among the dihydroxy carboxylic acid components, examples of straight-chain dihydroxy carboxylic acid components include: oxalic acid, malonic acid, succinic acid, glutaric acid, adipic acid, pimelic acid, suberic acid, azelaic acid, sebacic acid, and acid anhydrides, acid chlorides and lower alkyl esters (having 1 to 3 carbon atoms) thereof.

Among the dihydroxy carboxylic acid components, specific examples of non-straight-chain dihydroxy carboxylic acid compounds except for the above-mentioned straight-chain dihydroxy carboxylic acid compounds include: maleic acid, fumaric acid, citraconic acid, itaconic acid, glutaconic acid, terephthalic acid, isophthalic acid, phthalic acid, and acid anhydrides, acid chlorides and lower alkyl esters (having 1 to 3 carbon atoms) thereof.

With respect to the carboxylic acid components constituting a crystalline polyester resin, in addition to the above-mentioned dihydroxy carboxylic acid components, the following components may be used: n-dodecyl succinic acid, n-dodecenyl succinic acid, isododecyl succinic acid, isododecenyl succinic acid, n-octyl succinic acid, n-octenyl succinic acid and acid anhydrides, acid chlorides and lower alkyl esters (having 1 to 3 carbon atoms) thereof.

The rate of the straight-chain compounds in the total amount of the above-mentioned alcohol components and carboxylic acid components constituting a crystalline polyester resin is normally set in a range from 20 to 100% by weight, preferably from 30 to 100% by weight, more preferably from 40 to 100% by weight. Two or more kinds of the straight-chain compounds may be used in combination, and, for example, one or more kinds of straight-chain dihydroxy alcohol compounds and one or more kinds of straight-chain dihydroxy carboxylic acid compounds may be used in combination. In this case, the total amount of the straight-chain compounds is set within the above-mentioned range.

With respect to the crystalline polyester resin, two or more kinds of crystalline polyester resins having different compositions may be used. When two or more kinds of crystalline polyester resins are used, the softening point of any one of the resins is preferably set in the above-mentioned range.

With respect to the amorphous polyester resins other than the crystalline polyester resins, which are used for forming the shell layer, those resins composed of the above-mentioned polyhydroxy alcohol components and polycarboxylic acid components may be used. In the case when an amorphous polyester resin is added to the shell layer, not particularly limited, the softening point of the resin is normally set in a range from 80 to 130° C., preferably from 95 to 120° C. The content of the amorphous polyester resin is preferably set to not more than 40% by weight, preferably not more than 30% by weight, with respect to the total amount of the shell layer constituent resins.

The crystalline polyester resin and the amorphous polyester resin can be produced by subjecting predetermined alcohol component and carboxylic component to a polycondensing reaction under reduced pressure and/or in the presence of a catalyst, if necessary, through a heating process.

The shell layer may contain the above-mentioned urea-modified polyester resin. As described above, the urea-modified polyester resin may be contained in the core particles. In other words, it may be contained in either the core particles or the shell layer, or may be contained in both of these. By adding the urea-modified polyester resin to at least either the core particles or the shell layer, it becomes possible to further improve the heat-resistant storing property, and also to widen the non-offset temperature width; thus, for example, the non-offset temperature width is set to not less than 50° C. In an attempt to obtain the above-mentioned effects by using a comparatively small amount of the urea-modified polyester resin, the urea-modified polyester resin is preferably contained only in the shell layer.

When the shell layer is allowed to contain the urea-modified polyester resin, the content thereof is preferably set in a range from 2 to 40% by weight, preferably from 4 to 30% by weight, with respect to the total amount of the shell-layer constituent resins.

The shell layer can be formed by allowing crystalline polyester resin particles and amorphous polyester resin particles (hereinafter, referred to simply as "shell particles" on demand), if necessary, to adhere/fuse to the core particle surface in an aqueous medium so that the core particles are allowed to grow thereon. The term, "adhesion/fusion," refers to the concept that adhering and fusing processes take place simultaneously or step by step, or indicates the action that allows the adhering and fusing processes to take place simultaneously or step by step.

The crystalline polyester resin particles can be obtained by a flux suspension method. More specifically, after a crystalline polyester resin has been fused in an aqueous medium by heating under application of a pressure, if necessary, this is subjected to a granulating process under high-speed shear while being stirred, and cooled to room temperature to prepare resin particles.

In the same manner as the preparation of the aqueous medium in the dissolution-suspension method, a known surfactant may be appropriately added to the aqueous medium so as to stabilize the dispersion.

The amorphous polyester resin particles may be obtained through either the flux suspension method or the dissolution-suspension method.

The weight-average molecular weight of any of the crystalline polyester resin particles and the amorphous polyester resin particles is preferably set in a range from 30 to 300 nm.

In order to allow the shell particles to adhere/fuse to the surface of the core particles, it is preferable to carry out a shell-layer forming process in succession to the aggregating/fusing processes for obtaining the core particles. In other words, a dispersion solution of the shell particles is added to a dispersion solution of the core particles obtained through the aggregating/fusing processes of the resin particles. In this case, in order to allow the core particles to grow through the adhering/fusing processes of the shell particles, the process temperature is preferably set to a temperature that is the same as or higher than the reaction temperature at which the desired particle size has been achieved in the aggregating/fusing processes.

With respect to the means for controlling the adhering property (that is, aggregating property) of the shell particles to the core particles, the same means as described in the aggregating/fusing processes (such as adjusting means for the reaction temperature and the pH, the number of revolutions for stirring and the active agent of the system) can be used. The above-mentioned means are preferably used so as to prepare mild conditions in which the shell particles are allowed to adhere the core while avoiding mutual aggregation between the shell particles. When the above-mentioned means fail to allow the shell particles to adhere to the core particles, the flocculant, used in the aggregating/fusing processes, may be appropriately added thereto so as to increase the aggregating force to allow the adhesion.

The states in which the shell particles are allowed to adhere to the core particles and also to fuse thereto are confirmed by observing the surface of the particles sampled in the middle of the reaction under electron microscope. The sampled dispersion solution is separated by using a centrifugal separator so that the adhered state of all the shell particles can be confirmed by confirming that no cloud appears in a supernatant liquid. After having confirmed that all the shell particles suspended in the system have been adhered to the core particles, the aggregating force of the system is completely eliminated to stop the growth of the particles so that a film-forming process of the shell layer and a shape-controlling process for the particles are carried out (stages of maturing processes). The shape of the particles can be monitored on demand by using the aforementioned shape-measuring device FPIA-2000.

The blending weight ratio (core:shell) between resin particles constituting the core particles and resin particles constituting the shell layer is preferably set in a range from 95:5 to 70:30, preferably from 90:10 to 80:20.

In the present invention, an intermediate layer made from wax may be placed between the core particle surface and the shell layer, as described earlier. By placing the intermediate layer between the core particle surface and the shell layer, which will be described later, the wax is allowed to smoothly elute onto the toner particle surface at the time of fixing a toner image by the use of toner particles, making it possible to effectively prevent offsetting; thus, it becomes possible to prepare a comparatively wide anti-offsetting range. Consequently, a toner having a superior low-temperature fixing property is obtained. In this case, the wax may be contained in the core particles and the shell layer; however, normally, the wax is contained in only the intermediate layer.

With respect to the wax that can be used for forming the intermediate layer, those described earlier may be used. In particular, from the viewpoint of the adhering property between the core layer and the intermediate layer as well as between the intermediate layer and the shell layer, those waxes made from ester compounds indicated by the above-mentioned formula (1) are preferably used.

From the viewpoint of further decreasing the fixing temperature, the softening point of the wax forming the intermediate layer is preferably set in a range from 50 to 120° C., more preferably from 60 to 110° C. Two or more kinds of waxes may be used in combination, and in this case, the softening point of each of the waxes is preferably set in the above-mentioned range.

The above-mentioned ester compounds having such a softening point are commercially available as, for example, Electol WEP-5RF (made by NOF Corporation) and "Electol WE-2 (made by NOF Corporation).

With respect to the low-molecular weight polyethylene having the above-mentioned softening point is commercially available as, for example, Neowax LS made by (Yasuhara Chemical Co., Ltd.).

The intermediate layer can be formed by allowing desired wax particles to adhere/fuse to the surface of the core particle in an aqueous medium so as to grow the core particle.

The wax particles can be obtained by carrying out stirring/dispersing processes of the wax in water in the presence of a surfactant, and those in the form of a dispersion solution are normally used. The wax particles in the dispersion solution preferably have a dispersed particle size of not more than 1 μm, more preferably in a range from 30 to 300 nm.

In order to allow the wax particles to adhere/fuse onto the surface of the core particles, this intermediate layer forming process is preferably carried out in succession to the aforementioned aggregating/fusing processes used for obtaining the core particles. In other words, a dispersion solution of wax particles is added to the dispersion solution of core particles obtained through the adhering/fusing processes of the core particles. In this case, in order to allow the core particles to properly grow through the adhering/fusing processes of the wax particles, the corresponding reaction temperature is preferably set to the reaction temperature at which the desired particle size has been attained in the aggregating/fusing processes or a temperature not less than this temperature.

With respect to the means for controlling the adhering property (that is, aggregating property) of the wax particles to the core particles, the same means as described in the aggregating/fusing processes (such as adjusting means for the reaction temperature and the pH, the number of revolutions for stirring and the active agent of the system) can be used. The above-mentioned means are preferably used so as to prepare mild conditions in which the wax particles are allowed to adhere the core while avoiding mutual aggregation between the wax particles. When the above-mentioned means fail to allow the wax particles to adhere to the core particles, the flocculant, used in the aggregating/fusing processes, may be appropriately added thereto so as to increase the aggregating force to allow the adhesion.

The states in which the wax particles are allowed to adhere to the core particles and also to fuse thereto are confirmed by observing the surface of the particles sampled in the middle of the reaction under electron microscope. After having confirmed that all the wax particles suspended in the system have been adhered to the core particles, the sequence normally proceeds to a shell-layer forming process.

The blending weight ratio (core:wax) between resin particles constituting the core particles and the wax particles is preferably set in a range from 95:5 to 70:30, preferably from 90:10 to 80:20.

The intermediate layer may contain another component, if necessary, and in this case, the other component in the form of a dispersion solution is added thereto together with the wax particles. Not particularly limited, the other component includes resin particles and the like that can constitute the core particles. The content of the other component is properly set to not more than 20% by weight with respect to all the waxes forming the intermediate layer.

In the case when the intermediate layer is placed, the softening point of the crystalline polyester resin forming the shell layer is properly set within the above-mentioned range, and the softening point of the wax forming the intermediate layer is preferably set to a level lower than the softening point of the crystalline polyester resin. This arrangement allows the wax to quickly elute onto the surface of the toner particles, making it possible to effectively expand the non-offset temperature width. In the case when two or more kinds of crystalline polyester resins are used, the softening point of the crystalline polyester resins refers to the softening point of the crystalline polyester resin having the lowest softening point, and in the case when two or more kinds of waxes are used, the softening point of the waxes refers to the softening point of the wax having the highest softening point.

From the viewpoint of easiness of elution in the wax in the intermediate layer at a low temperature, the softening point of the crystalline polyester resin forming the shell layer is preferably lower than the softening point of the resin forming the core particles. In the case when two or more kinds of crystalline polyester resins are used, the softening point of the crystalline polyester resins refers to the softening point of the crystalline polyester resin having the highest softening point, and in the case when two or more kinds of core-particle constituent resins are used, the softening point of the core-particle constituent resins refers to the softening point of the resin having the lowest softening point.

The shape of toner particles having a core-shell structure obtained as described above (preferably having an average degree of roundness=0.930 to 0.995) is easily controlled by adjusting the shape of core particles (preferably having an average degree of roundness=0.850 to 0.950) and the heating conditions in the adhering/fusing processes in the maturing process stage.

The resulting toner particles are normally subjected to a washing treatment, a drying treatment and an externally adding treatment.

In particular, in the externally adding treatment, a single or a plurality of kinds of external additive agents are added to, and mixed in the toner particles that have been dried. With respect to the device used for adding and mixing the external additive agents, various known mixing devices and surface-modifying devices, such as a tabular mixer, a Henschel mixer, a Nauta mixer, a hybridizer and a V-type mixer, may be used. In the case when a plurality of kinds of external additive agents are added in these processes, all the external additive agents may be mixed at one time, or may be mixed in a separate manner.

The resulting particles are preferably filtered through a sieve of 30 to 200 μm mesh so as to remove bulky particles.

With respect to the external additive agents, various inorganic oxide fine particles, such as silica, alumina, titania, strontium titanate and cerium oxide, fine particles that have been subjected to a hydrophobicity-applying treatment, vinyl-based monomers and metal soups, such as zinc stearate and calcium stearate, if necessary, may be used. In particular, in full-color toners that are subjected to complex processes, it is desirable to add functional particles that can further improve the fluidity, chargeability, transferring property and cleaning property thereto. The added amount of the external additive agents is preferably set in a range from 0.05 to 5 parts by weight with respect to the toner particles.

The toner of the present invention as described above has a superior low-temperature fixing property and heat-resistant storing property, and even when the fixing temperature is set in a comparatively low temperature range, for example, from 125 to 135° C., it is possible to carry out a preferable fixing process that is free from low-temperature offsetting. Consequently, even when applied to a simultaneous transferring/fixing system, it becomes possible to effectively prevent roughened surface of the intermediate transferring member, and consequently to provide an image free from irregularities in gloss.

As described above, the toner of the present invention makes it possible to carry out a preferable fixing process even at a comparatively low temperature, and the shell layer is allowed to fuse quickly so that the wax inside the core particles is allowed to elute quickly. In the case when an intermediate layer made from the above-mentioned wax is formed, the elution is exerted more quickly. With this arrangement, it is possible to effectively ensure a comparatively wider non-offset temperature width.

In the toner of the present invention, a polyester resin, which generally has strength higher than the styrene-acryl based resin, is contained in the shell layer so that it is possible to provide a superior anti-breaking property even when applied to a mono-component developing system. In the case when an intermediate layer made from the above-mentioned wax is placed, since the intermediate layer effectively ensures bonding between the core particles and the shell layer, it becomes possible to further improve the anti-breaking property.

Since the toner of the present invention has a core-shell structure, it is possible to provide a superior anti-filming property and image storing property.

The toner of the present invention may be used as a magnetic or non-magnetic mono-component developer, or may be mixed with carrier to be used as a two-component developer. In the case when the toner of the present invention is used as a two-component developer, the carrier particles can be made from conventionally known materials such as metals like iron, ferrite and magnetite, and alloys between these metals and metals such as aluminum and lead.

<Image-forming Method>

With respect to the image-forming method of the present invention, as long as the above-mentioned electrostatic-latent-image-use toner is used, the other arrangements are not particularly limited. Referring to FIG. 1, the following description will briefly discuss a basic structure of the image-forming method of the present invention.

FIG. 1 is a schematic block diagram that shows one example of an image-forming apparatus which uses the image-forming method of the present invention. The image-forming apparatus is normally provided with a photosensitive member (image-bearing member) 10, a charging device 12, an exposing device 13, a developing device 14, a transferring device 15, a cleaning device 16, a light static eliminator 17 and a fixing device 18 and the above-mentioned toner, and the toner is housed in the developing device 14.

Upon forming an image, the photosensitive member 10 is first rotated so that the surface of the photosensitive member is charged by the charging device 12 such as a corona charger. Next, the surface of the charged photosensitive member 10 is subjected to exposure in a digital format or an analog format by the exposing device 13 so that an electrostatic latent image is formed on the surface of the photosensitive member 10. The above-mentioned toner is supplied onto the surface of the photosensitive member 10 bearing the electrostatic latent image formed thereon from the developing device 14 so that a toner image corresponding to the electrostatic latent image is formed on the surface of the photosensitive member 10. In the developing device 14, the toner may be stored as a mono-component developer using only the toner, or may be stored as a two-component developer in which the toner and carrier are mixed. The developing operation of the developing device 14 may be either an inversion developing operation or a normal developing operation. Next, the toner image, formed on the surface of the photosensitive member 10, is transferred onto a recording member 20 such as recording paper through the transferring member 15 such as a transfer-separation charger. After the toner image has been transferred onto the recording member, the residual toner on the surface of the photosensitive member 10 is removed by the cleaning device 16. After the surface of the photosensitive member has been cleaned, light is applied to the surface of the photosensitive member 10 from the light static eliminator 17 such as an LED and a cold cathode-ray tube so that residual potential is eliminated from the surface of the photosensitive member 10.

The image-forming method of the present invention is not intended to be limited only by the above-mentioned example. Although the apparatus of FIG. 1 has only one developing device, the image-forming method of the present invention may be used in a full-color image-forming apparatus which has a plurality of developing devices having toners of different colors and an intermediate transferring member which temporarily holds a toner image prior to transferring the toner image on the photosensitive member onto the recording member.

<Simultaneous Transferring/Fixing System>

The image-forming method of the present invention preferably adopts a simultaneous transferring/fixing system. Since the above-mentioned toner has a superior low-temperature fixing property to decrease the fixing temperature, it is preferably applied to the simultaneous transferring/fixing system in which the intermediate transferring member is heated for the fixing process so that the heating temperature of the intermediate transferring member is effectively lowered; thus, it becomes possible to effectively prevent roughened surface of the intermediate transferring member, and consequently to prevent occurrence of gloss irregularities.

Figure 2:
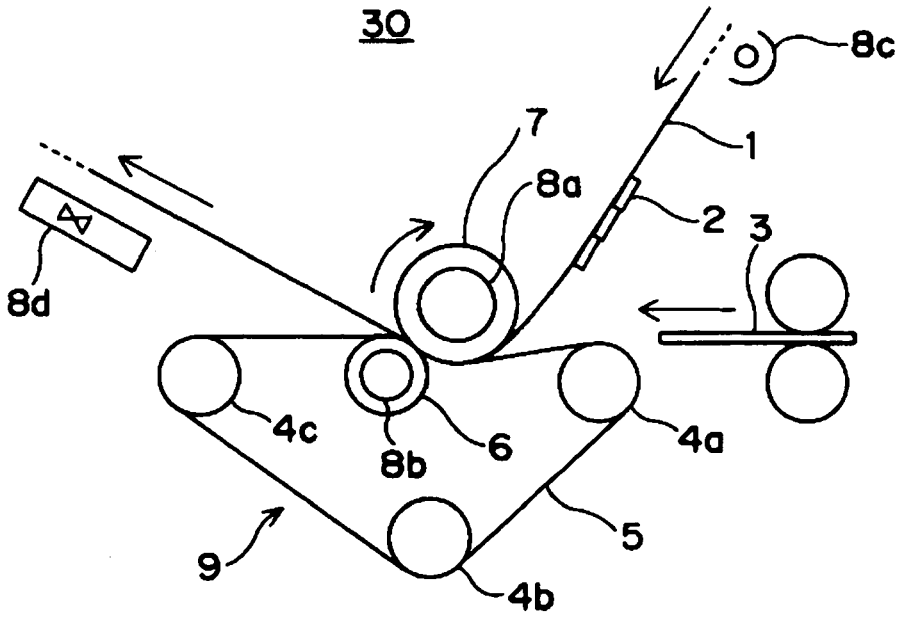
FIG. 2 is a schematic block diagram that shows one example of a simultaneous transferring/fixing device that is suitable for the image-forming method of the present invention.

In the simultaneous transferring/fixing system, upon transferring a toner image on the intermediate transferring member onto a recording medium to be fixed thereon, the fixing process is simultaneously carried out together with the transferring process. Referring to FIG. 2, the following description will briefly discuss the simultaneous transferring/fixing system. FIG. 2 is a schematic block diagram that shows one example of transferring/fixing device 30 that is used for a fixing process (simultaneous transferring/fixing process) in which the simultaneous transferring/fixing system is adopted in the image-forming method of the present invention. This transferring/fixing device 30 is a transferring/fixing device of a belt-nip system in which a fixing roller 7 and a belt nip device 9 are aligned face to face with each other with the intermediate transferring member 1 interpolated in between. The belt nip device 9 is provided with a heat resistant belt 5 that is extended and supported by supporting rollers 4*a*, 4*b*, 4*c*, and a pressure roller 6 is placed inside the heat-transferring belt 5. A heater lamp 8*b* is placed inside the pressure roller 6 to heat the surface of the pressure roller 6. Alternatively, the pressure roller 6 may have no heating means inside thereof. The surface of the fixing roller 7 is coated with an elastic member, with a heater lamp 8*a* placed inside thereof, so as to heat the surface of the fixing roller 7. In this case also, no heating means may be installed therein.

In the transferring/fixing device 30 shown in FIG. 2, the heat resistant belt 5 is pressed onto the fixing roller 7 so as to form a nip between the fixing roller 7 and the heat resistant belt 5 that is extended and supported by the supporting rollers 4*a*, 4*b*, 4*c* so that at the outlet of the nip, the elastic member of the fixing roller 7 is allowed to have a recess through the heat resistant belt 5 by the pressure roller 6 placed inside the heat resistant belt 5. With respect to the fixing roller 7 and the pressure roller 6, those rollers formed by placing heat resistant layers on metal rollers may be used. With respect to the metal rollers, examples thereof include hollow rollers made of aluminum, iron, copper or the like. With respect to components forming the above-mentioned heat resistant layers, examples thereof include: silicone rubber, fluororubber, fluorolatex, fluorocarbon resins and the like. The thickness of the heat resistant elastic layer may be appropriately selected depending on the purposes. Although not particularly limited, examples of the material of the heat resistant belt 5 include: polyimide films, stainless belts and the like.

In the transferring/fixing device 30 of FIG. 2, upon carrying out a fixing process simultaneously with a transferring process of a toner image on the intermediate transferring member onto a recording medium, the toner image 2 formed on the intermediate transferring member 1 is heated to fuse by the heating device 8*c*. The heat resistant belt 5 is made in press-contact with the fixing roller 7 in response to a paper feeding process of paper (recording medium) 3. The toner image 2, held on the intermediate transferring member 1, is pressed onto the heat-resistant belt 5 by the intermediate transferring member 1 while being sandwiched between the intermediate transferring member 1 and the paper 3. Next, the intermediate transferring member 1 and the paper 3 are shifted between the fixing roller 7 and the pressure roller 6 so as to be further pressed hard and heated. Then, the intermediate transferring member 1 and the paper 3, integrally transported from a heating area, are cooled by a cooling device 8*d* so that the simultaneous transferring/fixing processes are consequently achieved.

<Full-color Image-forming Method>

Figure 3:
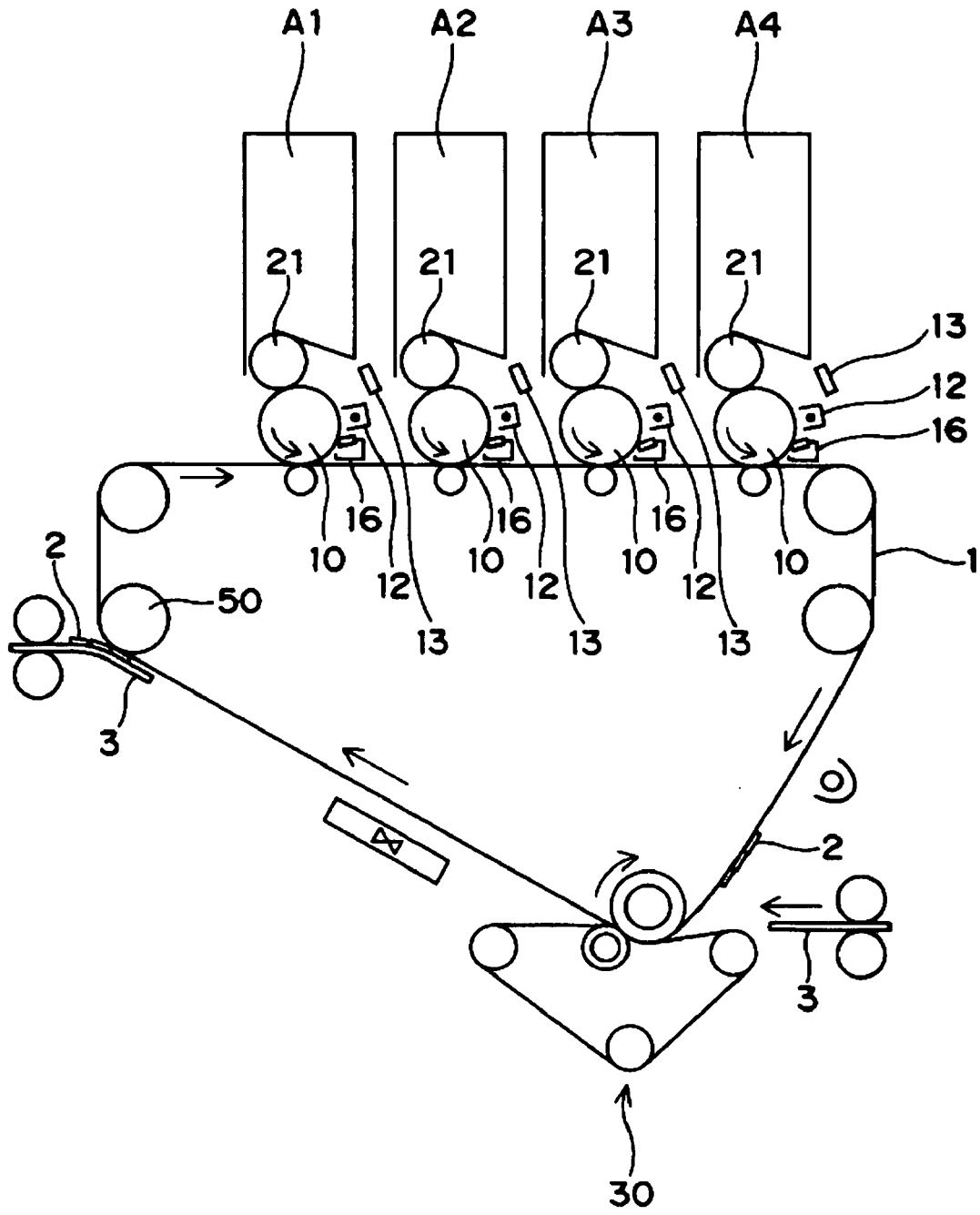
FIG. 3 is a schematic block diagram that shows a full-color image-forming apparatus having the simultaneous transferring/fixing device of FIG. 2.

The image-forming method of the present invention in which the simultaneous transferring/fixing system, in particular, the full-color image-forming method, is provided with a transferring process for transferring a toner image formed on the photosensitive member (image-bearing member) onto an intermediate transferring member, and a simultaneous transferring/fixing process for transferring and fixing the toner image from the intermediate transferring member onto a recording medium. Referring to FIG. 3, the following description will discuss such a full-color image-forming method of the present invention. FIG. 3 is a schematic block diagram that shows one example of a full-color image-forming apparatus which uses the image-forming method of the present invention.

The full-color image-forming apparatus, shown in FIG. 3, is provided with the transferring/fixing device 30 for carrying out the simultaneous transferring/fixing processes as shown in FIG. 2 and a full-color developing mechanism. The full-color developing mechanism has a tandem system using four developing devices A1 to A4 and four photosensitive members 10, and the four developing devices A1 to A4 respectively house the above-mentioned toners having different colors, that is, yellow, magenta, cyan and black. These four developing devices A1 to A4 are placed in the full-color image-forming apparatus in parallel with one another, and photosensitive members 10 are respectively placed in a manner so as to face the toner-bearing member 21 in each of the developing devices A1 to A4. An intermediate transferring member 1, prepared as an endless belt, is placed at a position on the side opposite to the developing devices A1 to A4 with respect to the photosensitive member 10 so that the intermediate transferring member 1 is made in contact with the respective photosensitive members 10.

Upon forming a full-color image by using this full-color image-forming apparatus, the photosensitive member 10, which faces the toner-bearing member 21 of the first developing device A1 housing the yellow toner, is first rotated so that the surface of the photosensitive member 10 is evenly charged by a charging device 12, and the charged photosensitive member 10 is subjected to exposure corresponding to an image signal by an exposing device 13 so that an electrostatic latent image is formed on the surface of the photosensitive member 10. Yellow toner is supplied to the electrostatic latent image portion formed on the photosensitive member 10 from the toner-bearing member 21 at a developing area at which the photosensitive member 10 having the electrostatic latent image formed thereon and the toner-bearing member 21 in the first developing device A1 are aligned face to face with each other so that a yellow toner image corresponding to the electrostatic latent image is formed on the photosensitive member 10. Then, the yellow toner image, thus formed on the photosensitive member 10, is transferred onto the intermediate transferring member 1 (transferring process). Residual yellow toner on the photosensitive member 10 after the transferring process is removed from the photosensitive member 10 by a cleaning device 16, and the residual potential is then removed from the surface of the photosensitive member 10 by a light static eliminator (not shown).

Next, in the same manner as the first developing device A1, in the second to fourth developing devices A2 to A4 also, toner images of magenta, cyan and black are successively transferred onto the intermediate transferring member 1 (transferring process) so that a full-color toner image 2 is formed on the intermediate transferring member 1. Thereafter, the toner image on the intermediate transferring member is transferred onto paper (recording medium) 3 to be fixed thereon by the transferring/fixing device 30 in accordance with the above-mentioned simultaneous transferring/fixing system; thus, the simultaneous transferring/fixing processes are achieved (simultaneous transferring/fixing processes). After the simultaneous transferring/fixing processes, the intermediate transferring member 1 and the paper 3 are further transported, and at the supporting roller 50, the paper 3 is separated from the intermediate transferring member 1 together with the toner image 2 by its own strength in flexibility; thus, it becomes possible to provide a full-color image derived from the toner image fixed onto the paper.

EXAMPLES

The following description will discuss the invention in detail by reference to examples; however, the invention is not intended to be limited by these examples. In the following description, "parts" refer to "weight parts," unless otherwise indicated.

(Production of Resin Dispersion Solution)

Crystalline Resin 1:

Adipic acid (800 parts), 1,4-cyclohexane dimethanol (550 parts) and dibutyl tin (2 parts) were mixed in a flask, and heated to 240° C. and subjected to a dehydration-condensing process for 6 hours under a reduced pressure to obtain a resin. The resin had a softening point of 91° C. The melting point thereof was 87° C. The resulting resin (200 parts), ion exchanged water (784 parts) and anionic surfactant (Newlex R: made by NOF Corporation) (16 parts) were mixed and stirred by a homogenizer (Ultra-Turrax: made by IKA Japan K.K.), while being heated at 95° C., and then cooled to room temperature to obtain a dispersion solution of a crystalline resin 1 (average particle size: 160 nm).

Crystalline Resin 2:

Fumaric acid (800 parts), 1,4-butan diol (300 parts), 1,6-hexane diol (250 parts) and dibutyl tin (2 parts) were mixed in a flask, and heated to 240° C. and subjected to a dehydration-condensing process for 6 hours under a reduced pressure to obtain a resin. The resin had a softening point of 117° C. The melting point thereof was 116° C. The resulting resin (200 parts) and ion exchanged water (784 parts) were mixed and stirred by a homogenizer (Ultra-Turrax: made by IKA Japan K.K.), while being heated in an autoclave, and to this was then added 16 parts of anionic surfactant (Newlex R: made by NOF Corporation), and cooled to room temperature to obtain a dispersion solution of a crystalline resin 2 (average particle size: 160 nm).

Crystalline Resin 3:

Dimethyl sebacate (800 parts), ethylene glycol (550 parts) and dibutyl tin (2 parts) were mixed in a flask, and heated to 240° C. and subjected to a dehydration-condensing process for 6 hours under a reduced pressure to obtain a resin. The resin had a softening point of 64° C. The melting point thereof was 61° C. The resulting resin (200 parts), ion exchanged water (784 parts) and anionic surfactant (Newlex R: made by NOF Corporation)(16 parts ) were mixed and stirred by a homogenizer (Ultra-Turrax: made by IKA Japan K.K.), while being heated at 80° C., and then cooled to room temperature to obtain a dispersion solution of a crystalline resin 3 (average particle size: 160 nm).

Crystalline Resin 4:

Dimethyl sebacate (800 parts), ethylene glycol (550 parts) and dibutyl tin (2 parts) were mixed in a flask, and heated to 240° C. and subjected to a dehydration-condensing process for 6 hours under a reduced pressure to obtain a resin. The resin had a softening point of 51° C. The melting point thereof was 50° C. The resulting resin (200 parts), ion exchanged water (784 parts) and anionic surfactant (Newlex R: made by NOF Corporation) (16 parts ) were mixed and stirred by a homogenizer (Ultra-Turrax: made by IKA Japan K.K.), while being heated at 70° C., and then cooled to room temperature to obtain a dispersion solution of a crystalline resin 4 (average particle size: 160 nm).

Crystalline Resin 5:

Fumaric acid (800 parts), 1,4-butan diol (400 parts), 1,6-hexane diol (150 parts) and dibutyl tin (2 parts) were mixed in a flask, and heated to 240° C. and subjected to a dehydration-condensing process for 6 hours under a reduced pressure to obtain a resin. The resin had a softening point of 125° C. The melting point thereof was 123° C. The resulting resin (200 parts) and ion exchanged water (784 parts) were mixed and stirred by a homogenizer (Ultra-Turrax: made by IKA Japan K.K.), while being heated in an autoclave, and to this was then added 16 parts of anionic surfactant (Newlex R: made by NOF Corporation), and cooled to room temperature to obtain a dispersion solution of a crystalline resin 5 (average particle size: 160 nm)

Sulfonated Crystalline Resin 1:

Dimethyl terephthalate (720 parts), sodium dimethyl 5-sulfoisophthalate (80 parts), 1,10-decanediol (550 parts) and dibutyl tin (2 parts) were mixed in a flask, and heated to 240° C. and subjected to a dehydration-condensing process for 6 hours under a reduced pressure to obtain a resin. The resin had a softening point of 89° C. The melting point thereof was 87° C. The resulting resin (200 parts) and ion exchanged water (800 parts) were mixed and stirred by a homogenizer (Ultra-Turrax: made by IKA Japan K.K.), while being heated at 95° C., and then cooled to room temperature to obtain a dispersion solution of a sulfonated crystalline resin 1 (average particle size: 160 nm).

Sulfonated Crystalline Resin 2:

Dimethyl terephthalate (720 parts), sodium dimethyl 5-sulfoisophthalate (80 parts), 1,10-decanediol (550 parts) and dibutyl tin (2 parts) were mixed in a flask, and heated to 240° C. and subjected to a dehydration-condensing process for 6 hours under a reduced pressure to obtain a resin. The resin had a softening point of 105° C. The melting point thereof was 104° C. The resulting resin (200 parts) and ion exchanged water (800 parts) were mixed and stirred by a homogenizer (Ultra-Turrax: made by IKA Japan K.K.), while being heated in an autoclave, and then cooled to room temperature to obtain a dispersion solution of a sulfonated crystalline resin 2 (average particle size: 160 nm).

Polyester Resin 1 (PES 1):

Polyoxypropylene (2,2)-2,2-bis(4-hydroxyphenyl)propane (BPA-PO) (400 parts), polyoxyethylene(2,0)-2,2-bis (4-hydroxydiphenyl) propane adduct (BPA-EO)(600 parts), terephthalic acid (1200 parts), fumaric acid (800 parts) and dibutyl tin (4 parts) were mixed in a flask, and heated to 220° C. and subjected to a dehydration-condensing process for 8 hours under a reduced pressure to obtain an amorphous polyester resin. The resin had a softening point of 105° C. The melting point thereof was 64° C. The resulting resin (200 parts) was dissolved in THF (300 parts) at room temperature, and this solution was added to 800 parts of ion exchanged water that had been mixed and stirred by a homogenizer (Ultra-Turrax: made by IKA Japan K.K.) to be emulsified. The emulsion solution was heated to 70° C. so that excessive THF was distilled off to obtain a PES 1 dispersion solution (average particle size: 160 nm).

Polyester Resin 2 (PES 2):

BPA-PO (400 parts), BPA-EO (600 parts), terephthalic acid (1200 parts), fumaric acid (800 parts) and dibutyl tin (4 parts) were mixed in a flask, and heated to 220° C. and subjected to a dehydration-condensing process for 8 hours under a reduced pressure to obtain an amorphous polyester resin. The resin had a softening point of 108° C. The melting point thereof was 64° C. The resulting resin (200 parts) was dissolved in THF (300 parts) at room temperature, and this solution was added to 800 parts of ion exchanged water that had been mixed and stirred by a homogenizer (Ultra-Turrax: made by IKA Japan K.K.) to be emulsified. The emulsion solution was heated to 70° C. so that excessive THF was distilled off to obtain a PES 2 dispersion solution (average particle size: 160 nm).

Polyester Resin 3 (PES 3):

BPA-PO (600 parts), BPA-EO (400 parts), terephthalic acid (1200 parts), fumaric acid (700 parts) and dibutyl tin (4 parts) were mixed in a flask, and heated to 240° C. and subjected to a dehydration-condensing process for 8 hours under a reduced pressure to obtain an amorphous polyester resin. The resin had a softening point of 119° C. The melting point thereof was 61° C. The resulting resin (200 parts) was dissolved in THF (300 parts) at room temperature, and this solution was added to 800 parts of ion exchanged water that had been mixed and stirred by a homogenizer (Ultra-Turrax: made by IKA Japan K.K.) to be emulsified. The emulsion solution was heated to 70° C. so that excessive THF was distilled off to obtain a PES 3 dispersion solution (average particle size: 160 nm).

Urea-modified Polyester Resin 1 (Urea-modified PES 1):

BPA-EO (500 parts), isophthalic acid (250 parts), fumaric acid (100 parts) and dibutyl tin (3 parts) were put into a reaction vessel equipped with a cooling pipe, a stirring device and a nitrogen-introducing pipe, and allowed to react at 230° C. under normal pressure for 6 hours , and this was allowed to further react under a reduced pressure of 10 to 15 mmHg for 2 hours, and then cooled to 80° C., and then allowed to further react with 188 parts of isophorone diisocyanate for 2 hours to obtain a prepolymer containing isocyanate. Successively, this prepolymer (267 parts) was allowed to react with 14 parts of isophorone diamine at 50° C. for 2 hours to obtain a urea-modified polyester having a softening point of 108° C. The melting point thereof was 61° C. The resulting resin (200 parts) was dissolved in 300 parts of THF at room temperature, and ion exchanged water (800 parts) was added to this solution to be emulsified. The emulsion solution was heated to 70° C. so that excessive THF was distilled off to obtain a urea-modified PES 1 dispersion solution (average particle size: 160 nm).

Urea-modified Polyester Resin 2 (Urea-modified PES 2):

BPA-EO (500 parts), isophthalic acid (200 parts), fumaric acid (150 parts) and dibutyl tin (3 parts) were put into a reaction vessel equipped with a cooling pipe, a stirring device and a nitrogen-introducing pipe, and allowed to react at 230° C. under normal pressure for 6 hours , and this was allowed to further react under a reduced pressure of 10 to 15 mmHg for 2 hours, and then cooled to 80° C., and then allowed to further react with 188 parts of isophorone diisocyanate for 2 hours to obtain a prepolymer containing isocyanate. Successively, this prepolymer (267 parts) was allowed to react with 14 parts of isophorone diamine at 50° C. for 2 hours to obtain a urea-modified polyester having a softening point of 98° C. The melting point thereof was 61° C. The resulting resin (200 parts) was dissolved in 300 parts of THF at room temperature, and ion exchanged water (800 parts) was added to this solution to be emulsified. The emulsion solution was heated to 70° C. so that excessive THF was distilled off to obtain a urea-modified PES 2 dispersion solution (average particle size: 160 nm).

Sulfonated Polyester Resin 1 (Sulfonated PES 1):

BPA-PO (400 parts), BPA-EO (600 parts), terephthalic acid (1000 parts), fumaric acid (800 parts), sodium dimethyl 5-sulfoisophthalate (100 parts) and dibutyl tin (4 parts) were mixed in a flask, and heated to 220° C. and subjected to a dehydration-condensing process for 8 hours under a reduced pressure to obtain a sulfonated polyester resin. The resin had a softening point of 106° C. The melting point thereof was 64° C. The resulting resin (200 parts) and ion exchanged water (800 parts) were mixed and stirred by a homogenizer (Ultra-Turrax: made by IKA Japan K.K.), while being heated in an autoclave, and then cooled to room temperature to obtain a sulfonated PES 1 dispersion solution (average particle size: 160 nm).

(Production of Release-agent Dispersion Solution)

Release-agent Dispersion Solution 1 (WEP-5RF):

Electol WEP-5RF (made by NOF Corporation: softening point 82° C.) (200 parts), ion exchanged water (784 parts) and anionic surfactant (Newlex R: made by NOF Corporation)(16 parts ) were dissolved in an autoclave, and then dispersed by a homogenizer to prepare a release-agent dispersion solution 1 (average particle size: 200 nm).

Release-agent Dispersion Solution 2 (WE-2):

Electol WE-2 (made by NOF Corporation: softening point 60° C.) (200 parts), ion exchanged water (784 parts) and anionic surfactant (Newlex R: made by NOF Corporation) (16 parts) were dissolved in an autoclave, and then dispersed by a homogenizer to prepare a release-agent dispersion solution 2 (average particle size: 200 nm).

Release-agent Dispersion Solution 3 (Neowax LS):

Neowax LS (made by Yasuhara Chemical Co., Ltd.: softening point 110° C.) (200 parts), ion exchanged water (784 parts) and anionic surfactant (Newlex R: made by NOF Corporation)(16 parts ) were dissolved in an autoclave, and then dispersed by a homogenizer to prepare a release-agent dispersion solution 3 (average particle size: 210 nm).

(Production of Colorant Dispersion Solution)

Cyan Colorant Dispersion Solution C1:

| | |
|---|---|
| Pigment C.I. Pigment Blue 15:3 | 50 parts |
| Dodecyl sulfate Na salt | 10 parts |
| Ion exchanged water | 200 parts |

The above-mentioned materials were dispersed by a sand grinder mill to prepare a colorant dispersion solution C1 having a volume-average particle size (D50) of 170 nm.

Magenta Colorant Dispersion Solution M1:

The same processes as the manufacturing method of the cyan colorant dispersion solution C1 were carried out except that the pigment was changed to C.I. Pigment Red 122 to prepare a magenta colorant dispersion solution M1. The volume-average particle size (D50) of the pigment fine particles was 180 nm.

Yellow Colorant Dispersion Solution Y1:

The same processes as the manufacturing method of the cyan colorant dispersion solution C1 were carried out except that the pigment was changed to C.I. Pigment Yellow 74 to prepare a yellow colorant dispersion solution Y1. The volume-average particle size (D50) of the pigment fine particles was 150 nm.

Black Colorant Dispersion Solution K1:

The same processes as the manufacturing method of the cyan colorant dispersion solution C1 were carried out except that the pigment was changed to carbon black (Mogul L: made by Cabot Corporation) to prepare a black colorant dispersion solution K1. The volume-average particle size (D50) of the pigment fine particles was 160 nm.

Production 1 of Toner Particles

In the following description, the weight of the dispersion solution is represented by "solid component weight" unless otherwise indicated.

Example 1-1

(Formation of Core Particles)

To a four-neck flask equipped with a thermometer, a cooling pipe and a stirring device were loaded 500 g of PES 2 dispersion solution and 6.4 g of anionic surfactant (Newlex R: made by NOF Corporation), and stirred at 280 rpm for 40 minutes. To this were further added 75 g of release agent dispersion solution 1 and 48 g of colorant dispersion solution C1, and the pH thereof was adjusted to 10 by using 1N NaOH aqueous solution. To this was dripped 80 g of 10 wt % magnesium chloride aqueous solution in 10 minutes, and this was then abruptly heated to 56° C. and held at this temperature for 2 hours.

(Formation of Shell Layer)

Crystalline resin 1 dispersion solution (64 g) and PES 1 dispersion solution (11 g) were preliminarily mixed, and after the resulting mixed dispersion solution had been gradually added to the system, the system was heated to 85° C. and maintained for one hour. A small amount of the resulting dispersion solution was sampled and separated by a centrifugal separator, and after having confirmed that the supernatant became transparent, 4.8 g of anionic surfactant (Newlex R: made by NOF Corporation) was added thereto at once. Thereafter, this was heated to 94° C. and maintained at this temperature for one hour. This was cooled, washed and dried to obtain toner particles. The toner particles had a particle size of 5.0 μm and a degree of roundness of 0.988.

Example 1-2

The same processes as example 1-1 were carried out except that PES 1 dispersion solution was changed to sulfonated PES 1 dispersion solution to prepare toner particles. The toner particles had a particle size of 5.0 μm and a degree of roundness of 0.988.

Example 1-3

The same processes as example 1-1 were carried out except that crystalline resin 1 dispersion solution was changed to sulfonated crystalline resin 1 dispersion solution to prepare toner particles. The toner particles had a particle size of 5.0 μm and a degree of roundness of 0.988.

Example 1-4

The same processes as example 1-1 were carried out except that 500 g of PES 2 dispersion solution was changed to 400 g of PES 2 dispersion solution and 100 g of crystalline resin 1 dispersion solution to prepare toner particles. The toner particles had a particle size of 5.0 μm and a degree of roundness of 0.988.

Example 1-5

The same processes as example 1-1 were carried out except that 75 g of crystalline resin 1 dispersion solution was used without using PES 1 dispersion solution to prepare toner particles. The toner particles had a particle size of 5.0 μm and a degree of roundness of 0.988.

Example 1-6

The same processes as example 1-1 were carried out except that crystalline resin 1 dispersion solution was changed to 54 g, with PES 1 dispersion solution being changed to 21 g, to prepare toner particles. The toner particles had a particle size of 5.0 μm and a degree of roundness of 0.988.

Example 1-7

The same processes as example 1-1 were carried out except that crystalline resin 1 dispersion solution was changed to crystalline resin 2 dispersion solution, with PES 2 dispersion solution being changed to PES 3 dispersion solution as well as the shell-forming temperature of 85° C. being changed to 90° C., to prepare toner particles. The toner particles had a particle size of 5.0 μm and a degree of roundness of 0.988.

Example 1-8

The same processes as example 1-1 were carried out except that crystalline resin 1 dispersion solution was changed to crystalline resin 3 dispersion solution, with release agent dispersion solution 1 being changed to release agent dispersion solution 2 as well as the shell-forming temperature of 85° C. being changed to 62° C., to prepare toner particles. The toner particles had a particle size of 5.0 μm and a degree of roundness of 0.992.

Example 1-9

The same processes as example 1-1 were carried out except that 64 g of crystalline resin 1 dispersion solution was changed to 71 g of crystalline resin 3 dispersion solution, with 11 g of PES 1 dispersion solution being changed to 4 g and release agent dispersion solution 1 being changed to release agent dispersion solution 2, as well as the shell-forming temperature of 85° C. being changed to 62° C., to prepare toner particles. The toner particles had a particle size of 5.0 μm and a degree of roundness of 0.992.

Comparative Example 1-1

To a four-neck flask equipped with a thermometer, a cooling pipe and a stirring device were loaded 75 g of PES 2 dispersion solution, 425 g of crystalline resin 1 dispersion solution and 6.4 g of anionic surfactant (Newlex R: made by NOF Corporation), and stirred at 280 rpm for 40 minutes. To this were further added 75 g of release agent dispersion solution 1 and 48 g of colorant dispersion solution C1, and the pH thereof was adjusted to 10 by using 1N NaOH aqueous solution. To this was dripped 80 g of 10 wt % magnesium chloride aqueous solution in 10 minutes, and this was then abruptly heated to 56° C. and held at this temperature for 2 hours.

To this was added 4.8 g of anionic surfactant (Newlex R: made by NOF Corporation) at once. Thereafter, this was heated to 92° C. and maintained at this temperature for one hour. This was cooled, washed and dried to obtain toner particles. The toner particles had a particle size of 5.8 μm and a degree of roundness of 0.982.

Comparative Example 1-2

To a four-neck flask equipped with a thermometer, a cooling pipe and a stirring device were loaded 500 g of PES 2 dispersion solution and 6.4 g of anionic surfactant (Newlex R: made by NOF Corporation), and stirred at 280 rpm for 40 minutes. To this were further added 75 g of release agent dispersion solution 1 and 48 g of colorant dispersion solution C1, and the pH thereof was adjusted to 10 by using 1N NaOH aqueous solution. To this was dripped 80 g of 10 wt % magnesium chloride aqueous solution in 10 minutes, and this was then abruptly heated to 56° C. and held at this temperature for 2 hours.

After 75 g of PES 1 dispersion solution had been gradually added to the system, the system was heated to 85° C. and maintained for one hour. A small amount of the resulting dispersion solution was sampled and separated by a centrifugal separator, and after having confirmed that the supernatant became transparent, 4.8 g of anionic surfactant (Newlex R: made by NOF Corporation) was added thereto at once. Thereafter, this was heated to 94° C. and maintained at this temperature for one hour. This was cooled, washed and dried to obtain toner particles. The toner particles had a particle size of 5.4 μm and a degree of roundness of 0.984.

Comparative Example 1-3

The same processes as example 1-1 were carried out except that 64 g of crystalline resin 1 dispersion solution was changed to 45 g, with 11 g of PES 1 dispersion solution being changed to 30 g, to prepare toner particles. The toner particles had a particle size of 5.0 μm and a degree of roundness of 0.988.

Comparative Example 1-4

To a four-neck flask equipped with a thermometer, a cooling pipe and a stirring device were loaded 500 g of PES 2 dispersion solution and 6.4 g of anionic surfactant (Newlex R: made by NOF Corporation), and stirred at 280 rpm for 40 minutes. To this were further added 75 g of release agent dispersion solution 1 and 48 g of colorant dispersion solution C1, and the pH thereof was adjusted to 10 by using 1N NaOH aqueous solution. To this was dripped 80 g of 10 wt % magnesium chloride aqueous solution in 10 minutes, and this was then abruptly heated to 56° C. and held at this temperature for 2 hours. This was then cooled to 50° C.

Dispersion solution of crystalline resin 4 (64 g) and PES 1 dispersion solution (11 g) were preliminarily mixed, and after the resulting mixed dispersion solution had been gradually added to the system, the system, as it was, was maintained for one hour. A small amount of the resulting dispersion solution was sampled and separated by a centrifugal separator, and after having confirmed that the supernatant became transparent, 4.8 g of anionic surfactant (Newlex R: made by NOF Corporation) was added thereto at once. Thereafter, this was heated to 55° C. and maintained at this temperature for one hour. This was cooled, washed and dried to obtain toner particles. The toner particles had a particle size of 5.9 μm and a degree of roundness of 0.980.

Comparative Example 1-5

To a four-neck flask equipped with a thermometer, a cooling pipe and a stirring device were loaded 500 g of PES 2 dispersion solution and 6.4 g of anionic surfactant (Newlex R: made by NOF Corporation), and stirred at 280 rpm for 40 minutes. To this were further added 75 g of release agent dispersion solution 1 and 48 g of colorant dispersion solution C1, and the pH thereof was adjusted to 10 by using 1N NaOH aqueous solution. To this was dripped 80 g of 10 wt % magnesium chloride aqueous solution in 10 minutes, and this was then abruptly heated to 56° C. and held at this temperature for 2 hours.

Dispersion solution of crystalline resin 5 (64 g) and PES 1 dispersion solution (11 g) were preliminarily mixed, and after the resulting mixed dispersion solution had been gradually added to the system, the system was heated to 95° C., and maintained for one hour. A small amount of the resulting dispersion solution was sampled and separated by a centrifugal separator, and after having confirmed that the supernatant became transparent, 4.8 g of anionic surfactant (Newlex R: made by NOF Corporation) was added thereto at once. Thereafter, this was maintained for one hour. This was cooled, washed and dried to obtain toner particles. The toner particles had a particle size of 6.2 μm and a degree of roundness of 0.984.

Comparative Example 1-6

To a four-neck flask equipped with a thermometer, a cooling pipe and a stirring device were loaded 400 g of PES 2 dispersion solution, 100 g of crystalline resin 1 dispersion solution and 6.4 g of anionic surfactant (Newlex R: made by NOF Corporation), and stirred at 280 rpm for 40 minutes. To this were further added 75 g of release agent dispersion solution 1 and 48 g of colorant dispersion solution C1, and the pH thereof was adjusted to 10 by using 1N NaOH aqueous solution. To this was dripped 80 g of 10 wt % magnesium chloride aqueous solution in 10 minutes, and this was then abruptly heated to 56° C. and held at this temperature for 2 hours.

After 75 g of PES 1 dispersion solution had been gradually added to the system, the system was heated to 85° C. and maintained for one hour. A small amount of the resulting dispersion solution was sampled and separated by a centrifugal separator, and after having confirmed that the supernatant became transparent, 4.8 g of anionic surfactant (Newlex R: made by NOF Corporation) was added thereto at once. Thereafter, this was heated to 94° C. and maintained at this temperature for one hour. This was cooled, washed and dried to obtain toner particles. The toner particles had a particle size of 5.8 μm and a degree of roundness of 0.980.

TABLE 1-1

| | | Shell | | | | | Core Resin A | | |
|---|---|---|---|---|---|---|---|---|---|
| | | Crystalline PES | | | Amorphous resin 1 | | | | |
| | | Resin | Softening point (° C.) | Content (resin ratio for shell, wt %) | Resin | Softening point (° C.) | Resin | Softening point (° C.) | Content (weight ratio to total core resin) |
| Example | 1-1 | Crystalline resin 1 | 91 | 85% | PES1 | 105 | PES2 | 108 | 100% |
| | 1-2 | Crystalline resin 1 | 91 | 85% | sulfonated PES1 | 106 | PES2 | 108 | 100% |
| | 1-3 | Sulfonated Crystalline resin 1 | 89 | 85% | PES1 | 105 | PES2 | 108 | 100% |
| | 1-4 | Crystalline resin 1 | 91 | 85% | PES1 | 105 | PES2 | 108 | 80% |
| | 1-5 | Crystalline resin 1 | 91 | 100% | — | — | PES2 | 108 | 100% |
| | 1-6 | Crystalline resin 1 | 91 | 72% | PES1 | 105 | PES2 | 108 | 100% |
| | 1-7 | Crystalline resin 2 | 117 | 85% | PES1 | 105 | PES3 | 119 | 100% |

TABLE 1-1-continued

| | | | | | | | | |
|---|---|---|---|---|---|---|---|---|
| | 1-8 | Crystalline resin 3 | 64 | 85% | PES1 | 105 | PES2 | 108 | 100% |
| | 1-9 | Crystalline resin 3 | 64 | 95% | PES1 | 105 | PES2 | 108 | 100% |
| Comparative example | 1-1 | — | — | — | — | — | PES2 | 108 | 15% |
| | 1-2 | — | — | — | PES1 | 105 | PES2 | 108 | 100% |
| | 1-3 | Crystalline resin 1 | 91 | 60% | PES1 | 105 | PES2 | 108 | 100% |
| | 1-4 | Crystalline resin 4 | 51 | 85% | PES1 | 105 | PES2 | 108 | 100% |
| | 1-5 | Crystalline resin 5 | 125 | 85% | PES1 | 105 | PES2 | 108 | 100% |
| | 1-6 | — | — | — | PES1 | 105 | PES2 | 108 | 100% |

| | | | Core | | | | | | |
|---|---|---|---|---|---|---|---|---|---|
| | | | Resin B | | | | | | |
| | | | | | Content (weight | Wax 1 | | | |
| | | | Resin | Softening point (° C.) | ratio to total core resin) | Kind | Trade name | Softening point (° C.) | Addition amount |
| | Example | 1-1 | — | — | — | Ester wax | WEP-5RF | 82 | 15% |
| | | 1-2 | — | — | — | Ester wax | WEP-5RF | 82 | 15% |
| | | 1-3 | — | — | — | Ester wax | WEP-5RF | 82 | 15% |
| | | 1-4 | Crystalline resin 1 | 91 | 20% | Ester wax | WEP-5RF | 82 | 15% |
| | | 1-5 | — | — | — | Ester wax | WEP-5RF | 82 | 15% |
| | | 1-6 | — | — | — | Ester wax | WEP-5RF | 82 | 15% |
| | | 1-7 | — | — | — | Ester wax | WEP-5RF | 82 | 15% |
| | | 1-8 | — | — | — | Ester wax | WE-2 | 60 | 15% |
| | | 1-9 | — | — | — | Ester wax | WE-2 | 60 | 15% |
| | Comparative example | 1-1 | Crystalline resin 1 | 91 | 85% | Ester wax | WEP-5RF | 82 | 15% |
| | | 1-2 | — | — | — | Ester wax | WEP-5RF | 82 | 15% |
| | | 1-3 | — | — | — | Ester wax | WEP-5RF | 82 | 15% |
| | | 1-4 | — | — | — | Ester wax | WEP-5RF | 82 | 15% |
| | | 1-5 | — | — | — | Ester wax | WEP-5RF | 82 | 15% |
| | | 1-6 | Crystalline resin 1 | 91 | 20% | Ester wax | WEP-5RF | 82 | 15% |

In each of the examples and comparative examples, in addition to the cyan toner particles, magenta toner particles, yellow toner particles and black toner particles were also obtained by carrying out the same processes as the manufacturing method of the cyan toner particles except that magenta colorant dispersion solution M1, yellow colorant dispersion solution Y1 and black colorant dispersion solution K1 were respectively used in place of cyan colorant dispersion solution C1.

(Production of Toner)

To the resulting toner particles were added 0.8% by weight of hydrophobic silica (H2000, 15 nm: made by Hoechst Japan Limited) and 0.4% by weight of hydrophobic titania (STT30A, 30 nm: made by Titan Kogyo K.K.) as external additive agents, and this was mixed by a Henschel mixer so as to carry out addition processes; thus, a toner was obtained.

(Evaluation of Toner)

<Heat Resistant Storing Property>

Cyan toner (20 g) was put into a glass bottle of 50 ml, and after having been left at a high temperature of 50° C. for 24 hours, the toner was visually observed to evaluate the heat resistant storing property.

○: There were no aggregated toner particles, causing no problem.

Δ: Soft aggregation was slightly observed, but easily crumbled with a slight force, causing no problems in practical use.

x: Firmly aggregated clumps were observed, and hardly crumbled to cause serious problems in practical use.

The toners having four colors, obtained from the respective examples or comparative examples, were loaded into an actual machine, and evaluated.

First, the following evaluation processes were carried out by using a color laser printer (magicolor 2300 DL; made by Minolta-QMS Co., Ltd.) having a transferring mechanism and a fixing mechanism separately.

<Fixing Property; Non-offset Temperature Width>

The fixing device of the machine is modified so as to desirably set the fixing temperature thereof. By changing the temperature of the fixing roller, a solid image having superposed three colors (Y, M and C) with a total amount of adhesion of 15 g/m$^2$ was outputted with respect to the low-temperature side. A mono-color gradation image with an amount of adhesion of 0 to 5.0 g/m$^2$ was outputted for each of the colors, with respect to the high-temperature side. Thus, each image on paper after passing through the fixing roller was observed. In each of the images, evaluation was made based upon a fixing temperature width (non-offset temperature width) in which neither low-temperature offset nor high-temperature offset occurred. With respect to the paper, CF paper (basis weight 80 g/m$^2$), which is standard paper for use in CF900, was used. Images having even a slight offset were evaluated as "defective."

○: Non-offset temperature width was wider than 40° C.

Δ: Non-offset temperature width was from not less than 30° C. to less than 40° C.

x: Non-offset temperature width was less than 30° C.

<Low-temperature Fixing Property; Bending Test>

The copied image, fixed on copy paper at 130° C. in the above-mentioned evaluation method of the non-offset temperature width, was folded into two from the middle portion, and the separating property thereof was visually observed.

○: No separation occurred on the image, causing no problems in practical use.

Δ: Although separations occurred slightly on the image, no problems were raised in practical use.

x: Serious separations occurred on the image, causing problems in practical use.

<Durability (Anti-breaking Property)>

In the evaluation processes, endurance test processes of 2000 sheets of white paper were carried out under L/L environments (10° C., 15%) and the toner to be evaluated was then taken out. The toner particles were observed under a reflection-type electronic microscope at a magnification of ×1000, five times with the viewing field being changed; thus, the average number of broken toner particles was found in 500 toner particles. The evaluation was made based upon the following criteria.

○: No broken toner particles were found, causing no problems in practical use.

Δ: Although 1 to 9 broken toner particles were present, no problems were raised in practical use.

x: Not less than 10 broken toner particles were present, causing problems in practical use.

<Anti-filming Property (Including BS Property)>

With respect to the printer, conditions on the photosensitive member and the intermediate transferring member were visually observed respectively after the initial process under L/L environments and after the initial process under N/N environments (23° C., 45%) as well as after continuous copying processes of 2000 sheets (after endurance tests). The continuous copying processes were carried out under a condition of C/W ratio of 6% using a predetermined print pattern.

○: Neither filming nor BS occurred on any of the photosensitive member and the intermediate transferring member.

Δ: Filming and BS occurred on either of the photosensitive member and the intermediate transferring member; however, no problem occurred on the image, causing no problems in practical use.

x: Filming and BS occurred on at least either of the photosensitive member and the intermediate transferring member, and the resulting adverse effects were observed on the image, causing problems in practical use.

<Image Storing Property>

Continuous copying processes for 10 sheets were carried out under a condition of C/W ratio of 6% using a predetermined print pattern. The copying processes were double sided copying processes. Ten sheets of the resulting images were superposed and stored at 50° C. for 24 hours. The conditions after the storage were visually observed and evaluated.

○: No adhered images were found, causing no problems in practical use.

x: Adhered images were found, and image losses occurred when separated, causing problems in practical use.

Next, by using a color copying machine (DiALTA Color CF3102; made by Minolta Co., Ltd.) which was modified to incorporate the simultaneous transferring/fixing device shown in FIG. 1, the following evaluation processes were carried out.

<Fixing Property; Non-offset Temperature Range>

The same evaluation method as the above-mentioned method for non-offset temperature range using a magicolor 2300DL was carried out except that a modified DiALTA Color CF3102 was used.

<Low-temperature Fixing Property; Bending Test>

The same evaluation method as the above-mentioned method for low-temperature fixing property using a magicolor 2300DL was carried out except that a modified DiALTA Color CF3102 was used.

<Gloss Irregularities>

The fixing temperature was set at +20° C. of the lower-limit fixing temperature (lower-limit temperature without causing low-temperature offsetting), and after endurance copying processes of 10,000 sheets, a solid pattern having an amount of toner adhesion of 12.5±0.5 g/m$^2$ was outputted, and conditions of the gloss irregularities were visually observed. The lower-limit fixing temperature refers to the lower-limit temperature within the non-offset temperature range measured in the evaluation processes for the non-offset temperature range. The fixing temperatures are shown in the following Table together with the results of the evaluation.

○: Difference between the highest degree of gloss and the lowest degree of gloss was hardly discernable.

Δ: Difference between the highest degree of gloss and the lowest degree of gloss was slightly discernable; however, no problems were raised in practical use.

x: Difference between the highest degree of gloss and the lowest degree of gloss was clearly discernable, causing problems in practical use.

TABLE 1-2

| | Result of evaluation | | | | | | | | | |
|---|---|---|---|---|---|---|---|---|---|---|
| | General | | | | | | Simultaneous transferring/fixing | | | |
| | | | | | | | Gloss irregularities | | | |
| | Low-temperature fixing property | Non-offset temperature width | Heat-resistant storing property | Image storing property | Anti-breaking property | Anti-filming | Result | Fixing temperature (° C.) | Non-offset temperature width | Low-temperature fixing property |
| Ex. 1-1 | ○ | ○ | ○ | ○ | ○ | ○ | ○ | 130 | ○ | ○ |
| Ex. 1-2 | ○ | ○ | ○ | ○ | ○ | ○ | ○ | 130 | ○ | ○ |
| Ex. 1-3 | ○ | ○ | ○ | ○ | ○ | ○ | ○ | 130 | ○ | ○ |
| Ex. 1-4 | ○ | ○ | ○ | ○ | ○ | ○ | ○ | 125 | ○ | ○ |
| Ex. 1-5 | ○ | ○ | ○ | ○ | Δ | ○ | ○ | 130 | ○ | ○ |
| Ex. 1-6 | ○ | ○ | ○ | ○ | ○ | ○ | ○ | 130 | ○ | ○ |
| Ex. 1-7 | ○ | ○ | ○ | ○ | ○ | ○ | ○ | 135 | ○ | ○ |
| Ex. 1-8 | ○ | ○ | ○ | ○ | ○ | ○ | ○ | 125 | ○ | ○ |
| Ex. 1-9 | ○ | ○ | ○ | ○ | ○ | ○ | ○ | 125 | ○ | ○ |
| Com. ex. 1-1 | ○ | Δ | X | ○ | X | X | ○ | 125 | X | X |
| Com. ex. 1-2 | X | X | X | ○ | ○ | ○ | Δ | 145 | X | X |
| Com. ex. 1-3 | Δ | X | ○ | ○ | X | X | ○ | 135 | X | Δ |
| Com. ex. 1-4 | ○ | X | X | X | X | X | ○ | 125 | X | Δ |
| Com. ex. 1-5 | X | X | ○ | ○ | ○ | ○ | X | 145 | X | X |
| Com. ex. 1-6 | X | X | X | ○ | ○ | ○ | X | 150 | X | X |

Production 2 of Toner Particles

Example 2-1

(Formation of Core Particles)

To a four-neck flask equipped with a thermometer, a cooling pipe and a stirring device were loaded 75 g of release agent dispersion solution 1, 75 g of release agent dispersion solution 3, 28 g of colorant dispersion solution C1 and 6.4 g of anionic surfactant (Newlex R: made by NOF Corporation), and stirred at 280 rpm for 40 minutes. After the pH thereof had been adjusted to 10 by using 1N NaOH aqueous solution, 24 g of 10 wt % magnesium chloride aqueous solution was dripped therein in 10 minutes, and this was then heated to 60° C. and held at this temperature for 2 hours.

(Formation of Shell Layer)

Crystalline resin 1 dispersion solution (85 g) and PES 1 dispersion solution (15 g) were preliminarily mixed, and after the resulting mixed dispersion solution had been gradually added to the system, the system was heated to 85° C. and maintained for 0.5 hour. Crystalline resin 1 dispersion solution (85 g) and PES 1 dispersion solution (15 g) were preliminarily mixed, and after the resulting mixed dispersion solution had been gradually added to the system, 8 g of 10 wt % magnesium chloride aqueous solution was again dripped therein, and the system was heated to 85° C. and maintained for 0.5 hour. Crystalline resin 1 dispersion solution (42.5 g) and PES 1 dispersion solution (7.5 g) were preliminarily mixed, and after the resulting mixed dispersion solution had been gradually added to the system, the system was heated to 85° C. and maintained for 0.5 hour. A small amount of the resulting dispersion solution was sampled and separated by a centrifugal separator, and after having confirmed that the supernatant became transparent, 4.8 g of anionic surfactant (Newlex R: made by NOF Corporation) was added thereto at once. Thereafter, this was heated to 94° C. and maintained at this temperature for one hour. This was cooled, washed and dried to obtain toner particles. The toner particles had a particle size of 6.0 μm and a degree of roundness of 0.984.

Example 2-2

(Formation of Core Particles)

To a four-neck flask equipped with a thermometer, a cooling pipe and a stirring device were loaded 75 g of release agent dispersion solution 1, 75 g of release agent dispersion solution 3, 28 g of colorant dispersion solution C1 and 6.4 g of anionic surfactant (Newlex R: made by NOF Corporation), and stirred at 280 rpm for 40 minutes. After the pH thereof had been adjusted to 10 by using 1N NaOH aqueous solution, 24 g of 10 wt % magnesium chloride aqueous solution was dripped therein in 10 minutes, and this was then heated to 60° C. and held at this temperature for 2 hours.

(Formation of Shell Layer)

After 100 g of crystalline resin 1 dispersion solution had been gradually added to the system, the system was heated to 85° C. and maintained for 0.5 hour. After crystalline resin 1 dispersion solution (100 g) had been gradually added to the system, 8 g of 10 wt % magnesium chloride aqueous solution was again dripped therein, and the system was heated to 85° C. and maintained for 0.5 hour. After crystalline resin 1 dispersion solution (50 g) had been gradually added to the system, the system was heated to 85° C. and maintained for 0.5 hour. A small amount of the resulting dispersion solution was sampled and separated by a centrifugal separator, and after having confirmed that the supernatant became transparent, 4.8 g of anionic surfactant (Newlex R: made by NOF Corporation) was added thereto at once. Thereafter, this was heated to 94° C. and maintained at this temperature for one hour. This was cooled, washed and dried to obtain toner particles. The toner particles had a particle size of 6.0 μm and a degree of roundness of 0.984.

Example 2-3

(Formation of Core Particles)

To a four-neck flask equipped with a thermometer, a cooling pipe and a stirring device were loaded 75 g of release agent dispersion solution 1, 75 g of release agent dispersion solution 3, 28 g of colorant dispersion solution C1 and 6.4 g of anionic surfactant (Newlex R: made by NOF Corporation), and stirred at 280 rpm for 40 minutes. After the pH thereof had been adjusted to 10 by using 1N NaOH aqueous solution, 24 g of 10 wt % magnesium chloride aqueous solution was dripped therein in 10 minutes, and this was then heated to 60° C. and held at this temperature for 2 hours.

(Formation of Shell Layer)

Crystalline resin 1 dispersion solution (72 g) and PES 1 dispersion solution (28 g) were preliminarily mixed, and after the resulting mixed dispersion solution had been gradually added to the system, the system was heated to 85° C. and maintained for 0.5 hour. Crystalline resin 1 dispersion solution (72 g) and PES 1 dispersion solution (28 g) were preliminarily mixed, and after the resulting mixed dispersion solution had been gradually added to the system, 8 g of 10 wt % magnesium chloride aqueous solution was again dripped therein, and the system was heated to 85° C. and maintained for 0.5 hour. Crystalline resin 1 dispersion solution (36 g) and PES 1 dispersion solution (14 g) were preliminarily mixed, and after the resulting mixed dispersion solution had been gradually added to the system, the system was heated to 85° C. and maintained for 0.5 hour. A small amount of the resulting dispersion solution was sampled and separated by a centrifugal separator, and after having confirmed that the supernatant became transparent, 4.8 g of anionic surfactant (Newlex R: made by NOF Corporation) was added thereto at once. Thereafter, this was heated to 94° C. and maintained at this temperature for one hour. This was cooled, washed and dried to obtain toner particles. The toner particles had a particle size of 6.0 μm and a degree of roundness of 0.984.

Example 2-4

The same processes as example 2-1 were carried out except that crystalline resin 1 dispersion solution was changed to crystalline resin 2 dispersion solution and that the shell-forming temperature of 85° C. was changed to 90° C., to prepare toner particles. The toner particles had a particle size of 5.6 μm and a degree of roundness of 0.980.

Example 2-5

The same processes as example 2-1 were carried out except that crystalline resin 1 dispersion solution was changed to crystalline resin 3 dispersion solution, with release agent dispersion solution 1 being changed to release agent dispersion solution 2, and that the shell-forming temperature of 85° C. was changed to 62° C., to prepare toner particles. The toner particles had a particle size of 6.2 μm and a degree of roundness of 0.990.

Example 2-6

(Formation of Core Particles)

To a four-neck flask equipped with a thermometer, a cooling pipe and a stirring device were loaded 75 g of release agent dispersion solution 2, 75 g of release agent dispersion solution 3, 28 g of colorant dispersion solution C1 and 6.4 g of anionic surfactant (Newlex R: made by NOF Corporation), and stirred at 280 rpm for 40 minutes. After the pH thereof had been adjusted to 10 by using 1N NaOH aqueous solution, 24 g of 10 wt % magnesium chloride aqueous solution was dripped therein in 10 minutes, and this was then heated to 60° C. and held at this temperature for 2 hours.

(Formation of Shell Layer)

Crystalline resin 3 dispersion solution (95 g) and PES 1 dispersion solution (5 g) were preliminarily mixed, and after the resulting mixed dispersion solution had been gradually added to the system, the system was heated to 62° C. and maintained for 0.5 hour. Crystalline resin 3 dispersion solution (95 g) and PES 1 dispersion solution (5 g) were preliminarily mixed, and after the resulting mixed dispersion solution had been gradually added to the system, 8 g of 10 wt % magnesium chloride aqueous solution was again dripped therein, and the system was heated to 62° C. and maintained for 0.5 hour. Crystalline resin 3 dispersion solution (47.5 g) and PES 1 dispersion solution (2.5 g) were preliminarily mixed, and after the resulting mixed dispersion solution had been gradually added to the system, the system was heated to 62° C. and maintained for 0.5 hour. A small amount of the resulting dispersion solution was sampled and separated by a centrifugal separator, and after having confirmed that the supernatant became transparent, 4.8 g of anionic surfactant (Newlex R: made by NOF Corporation) was added thereto at once. Thereafter, this was heated to 89° C. and maintained at this temperature for one hour. This was cooled, washed and dried to obtain toner particles. The toner particles had a particle size of 6.0 μm and a degree of roundness of 0.986.

Example 2-7

(Formation of Core Particles)

To a four-neck flask equipped with a thermometer, a cooling pipe and a stirring device were loaded 15 g of release agent dispersion solution 1, 15 g of release agent dispersion solution 3, 28 g of colorant dispersion solution C1 and 6.4 g of anionic surfactant (Newlex R: made by NOF Corporation), and stirred at 280 rpm for 40 minutes. After the pH thereof had been adjusted to 10 by using 1N NaOH aqueous solution, 5 g of 10 wt % magnesium chloride aqueous solution was dripped therein in 10 minutes, and this was then heated to 60° C. and held at this temperature for 2 hours.

(Formation of Shell Layer)

Crystalline resin 1 dispersion solution (85 g) and PES 1 dispersion solution (15 g) were preliminarily mixed, and after the resulting mixed dispersion solution had been gradually added to the system, the system was heated to 85° C. and maintained for 0.5 hour. Crystalline resin 1 dispersion solution (85 g) and PES 1 dispersion solution (15 g) were preliminarily mixed, and after the resulting mixed dispersion solution had been gradually added to the system, 20 g of 10 wt % magnesium chloride aqueous solution was again dripped therein, and the system was heated to 85° C. and maintained for 0.5 hour. Crystalline resin 1 dispersion solution (85 g) and PES 1 dispersion solution (15 g) were preliminarily mixed, and after the resulting mixed dispersion solution had been gradually added to the system, 20 g of 10 wt % magnesium chloride aqueous solution was again dripped therein, and the system was heated to 85° C. and maintained for 0.5 hour. Crystalline resin 1 dispersion solution (85 g) and PES 1 dispersion solution (15 g) were preliminarily mixed, and after the resulting mixed dispersion solution had been gradually added to the system, the system was heated to 85° C. and maintained for 0.5 hour. Then, crystalline resin 1 dispersion solution (59.5 g) and PES 1 dispersion solution (10.5 g) were preliminarily mixed, and after the resulting mixed dispersion solution had been gradually added to the system, the system was heated to 85° C. and maintained for 0.5 hour. A small amount of the resulting dispersion solution was sampled and separated by a centrifugal separator, and after having confirmed that the supernatant became transparent, 4.8 g of anionic surfactant (Newlex R: made by NOF Corporation) was added thereto at once. Thereafter, this was heated to 94° C. and maintained at this temperature for one hour. This was cooled, washed and dried to obtain toner particles. The toner particles had a particle size of 6.0 μm and a degree of roundness of 0.980.

Example 2-8

(Formation of Core Particles)

To a four-neck flask equipped with a thermometer, a cooling pipe and a stirring device were loaded 150 g of release agent dispersion solution 1, 125 g of release agent dispersion solution 3, 28 g of colorant dispersion solution C1 and 6.4 g of anionic surfactant (Newlex R: made by NOF Corporation), and stirred at 280 rpm for 40 minutes. After the pH thereof had been adjusted to 10 by using 1N NaOH aqueous solution, 44 g of 10 wt % magnesium chloride aqueous solution was dripped therein in 10 minutes, and this was then heated to 60° C. and held at this temperature for 2 hours.

(Formation of Shell Layer)

Crystalline resin 1 dispersion solution (85 g) and PES 1 dispersion solution (15 g) were preliminarily mixed, and after the resulting mixed dispersion solution had been gradually added to the system, the system was heated to 85° C. and maintained for 0.5 hour. Crystalline resin 1 dispersion solution (85 g) and PES 1 dispersion solution (15 g) were preliminarily mixed, and after the resulting mixed dispersion solution had been gradually added to the system, 20 g of 10 wt % magnesium chloride aqueous solution was again dripped therein, and the system was heated to 85° C. and maintained for 0.5 hour. Crystalline resin 1 dispersion solution (85 g) and PES 1 dispersion solution (15 g) were preliminarily mixed, and after the resulting mixed dispersion solution had been gradually added to the system, 20 g of 10 wt % magnesium chloride aqueous solution was again dripped therein, and the system was heated to 85° C. and maintained for 0.5 hour. Crystalline resin 1 dispersion solution (85 g) and PES 1 dispersion solution (15 g) were preliminarily mixed, and after the resulting mixed dispersion solution had been gradually added to the system, the system was heated to 85° C. and maintained for 0.5 hour. Then, crystalline resin 1 dispersion solution (59.5 g) and PES 1 dispersion solution (10.5 g) were preliminarily mixed, and after the resulting mixed dispersion solution had been gradually added to the system, the system was heated to 85° C. and maintained for 0.5 hour. A small amount of the resulting dispersion solution was sampled and separated by a centrifugal separator, and after having confirmed that the supernatant became transparent, 4.8 g of anionic surfactant (Newlex R: made by NOF Corporation) was added thereto at once. Thereafter, this was heated to 94° C. and maintained at this temperature for one hour. This was cooled, washed and dried to obtain toner particles. The toner particles had a particle size of 6.0 μm and a degree of roundness of 0.981.

Example 2-9

The same processes as example 2-1 were carried out except that 150 g of release agent dispersion solution 1 was used without using release agent dispersion solution 3 to prepare toner particles. The toner particles had a particle size of 6.0 μm and a degree of roundness of 0.984.

Example 2-10

The same processes as example 2-1 were carried out except that crystalline resin 1 dispersion solution was changed to crystalline resin 3 dispersion solution with the shell-forming temperature of 85° C. being changed to 62° C., to prepare toner particles. The toner particles had a particle size of 6.0 μm and a degree of roundness of 0.990.

Comparative Example 2-1

To a four-neck flask equipped with a thermometer, a cooling pipe and a stirring device were loaded 75 g of PES 2 dispersion solution, 425 g of crystalline resin 1 dispersion solution and 6.4 g of anionic surfactant (Newlex R: made by NOF Corporation), and stirred at 280 rpm for 40 minutes. To this were further added 75 g of release agent dispersion solution 1 and 48 g of colorant dispersion solution C1, and the pH thereof was adjusted to 10 by using 1N NaOH aqueous solution. To this was dripped 80 g of 10 wt % magnesium chloride aqueous solution in 10 minutes, and this was then abruptly heated to 56° C. and held at this temperature for 2 hours.

To this was added 4.8 g of anionic surfactant (Newlex R: made by NOF Corporation) at once. Thereafter, this was heated to 92° C. and maintained at this temperature for one hour. This was cooled, washed and dried to obtain toner particles. The toner particles had a particle size of 5.8 μm and a degree of roundness of 0.982.

Comparative Example 2-2

The same processes as example 2-1 were carried out except that, in the forming process of the shell layer, additions of 85 g of crystalline resin 1 dispersion solution and 15 g of PES 1 dispersion solution were changed to 100 g of PES 1 dispersion solution, with additions of 42.5 g of crystalline resin 1 dispersion solution and 7.5 g of PES 1 dispersion solution being changed to 50 g of PES 1 dispersion solution, to obtain toner particles. The toner particles had a particle size of 5.8 μm and a degree of roundness of 0.982.

Comparative Example 2-3

The same processes as example 2-1 were carried out except that, in the forming process of the shell layer, additions of 85 g of crystalline resin 1 dispersion solution and 15 g of PES 1 dispersion solution were respectively changed to 60 g of crystalline resin 1 dispersion solution and 40 g of PES 1 dispersion solution, with additions of 42.5 g of crystalline resin 1 dispersion solution and 7.5 g of PES 1 dispersion solution being respectively changed to 30 g of crystalline resin 1 dispersion solution and 20 g of PES 1 dispersion solution, and that the shell-forming temperature of 85° C. was changed to 90° C. to obtain toner particles. The toner particles had a particle size of 5.8 μm and a degree of roundness of 0.984.

Comparative Example 2-4

The same processes as example 2-1 were carried out except that, in the forming process of the shell layer, additions of 85 g of crystalline resin 1 dispersion solution and 15 g of PES 1 dispersion solution were respectively changed to 85 g of crystalline resin 4 dispersion solution and 15 g of PES 1 dispersion solution, with additions of 42.5 g of crystalline resin 1 dispersion solution and 7.5 g of PES 1 dispersion solution being respectively changed to 42.5 g of crystalline resin 4 dispersion solution and 7.5 g of PES 1 dispersion solution, to obtain toner particles. The toner particles had a particle size of 5.6 μm and a degree of roundness of 0.990.

Comparative Example 2-5

The same processes as example 2-1 were carried out except that, in the forming process of the shell layer, additions of 85 g of crystalline resin 1 dispersion solution and 15 g of PES 1 dispersion solution were respectively changed to 85 g of crystalline resin 5 dispersion solution and 15 g of PES 1 dispersion solution, with additions of 42.5 g of crystalline resin 1 dispersion solution and 7.5 g of PES 1 dispersion solution being respectively changed to 42.5 g of crystalline resin 5 dispersion solution and 7.5 g of PES 1 dispersion solution, and that the shell-forming temperature of 85° C. was changed to 92° C. to obtain toner particles to obtain toner particles. The toner particles had a particle size of 5.4 μm and a degree of roundness of 0.983.

Comparative Example 2-6

The same processes as example 2-1 were carried out except that, in the forming process of the core particles, 150 g of release agent dispersion solution 3 was used without using release agent dispersion solution 1 to obtain toner particles. The toner particles had a particle size of 5.8 μm and a degree of roundness of 0.984.

TABLE 2-1

| | | Core | | | | | | | | | | | | | |
|---|---|---|---|---|---|---|---|---|---|---|---|---|---|---|---|
| | | Resin A | | | Resin B | | | Wax 1 | | | | Wax 2 | | | |
| | | Resin | Softening point (° C.) | Content (weight ratio to total core resin) | Resin | Softening point (° C.) | Content (weight ratio to total core resin) | Kind | Trade name | Softening point (° C.) | Addition amount | Kind | Trade name | Softening point (° C.) | Addition amount |
| Example | 2-1 | — | — | — | — | — | — | Ester wax | WEP-5RF | 82 | 30% | PE | Neowax LS | 110 | 30% |
| | 2-2 | — | — | — | — | — | — | Ester wax | WEP-5RF | 82 | 30% | PE | Neowax LS | 110 | 30% |
| | 2-3 | — | — | — | — | — | — | Ester wax | WEP-5RF | 82 | 30% | PE | Neowax LS | 110 | 30% |
| | 2-4 | — | — | — | — | — | — | Ester wax | WEP-5RF | 82 | 30% | PE | Neowax LS | 110 | 30% |
| | 2-5 | — | — | — | — | — | — | Ester wax | WE-2 | 60 | 30% | PE | Neowax LS | 110 | 30% |
| | 2-6 | — | — | — | — | — | — | Ester wax | WE-2 | 60 | 30% | PE | Neowax LS | 110 | 30% |
| | 2-7 | — | — | — | — | — | — | Ester wax | WEP-5RF | 82 | 3.2% | PE | Neowax LS | 110 | 3.2% |
| | 2-8 | — | — | — | — | — | — | Ester wax | WEP-5RF | 82 | 32% | PE | Neowax LS | 110 | 27% |
| | 2-9 | — | — | — | — | — | — | Ester wax | WEP-5RF | 82 | 60% | — | — | — | — |
| | 2-10 | — | — | — | — | — | — | Ester wax | WEP-5RF | 82 | 30% | PE | Neowax LS | 110 | 30% |

※The addition amount of release-agent is a weight-ratio to resin for shell.
The mark "*" means a weight ratio to resin for core (solids).

TABLE 2-2

| | | Shell | | | | |
|---|---|---|---|---|---|---|
| | | Crystalline PES | | | Amorphous resin 1 | |
| | | Resin | Softening point (° C.) | Content (resin ratio for shell, wt %) | Resin | Softening point (° C.) |
| Example | 2-1 | Crystalline resin 1 | 91 | 85% | PES1 | 105 |
| | 2-2 | Crystalline resin 1 | 91 | 100% | — | — |
| | 2-3 | Crystalline resin 1 | 91 | 72% | PES1 | 105 |
| | 2-4 | Crystalline resin 2 | 117 | 85% | PES1 | 105 |
| | 2-5 | Crystalline resin 3 | 64 | 85% | PES1 | 105 |
| | 2-6 | Crystalline resin 3 | 64 | 95% | PES1 | 105 |
| | 2-7 | Crystalline resin 1 | 91 | 85% | PES1 | 105 |

TABLE 2-2-continued

| | Shell | | | | |
|---|---|---|---|---|---|
| | Crystalline PES | | | Amorphous resin 1 | |
| | Resin | Softening point (° C.) | Content (resin ratio for shell, wt %) | Resin | Softening point (° C.) |
| 2-8 | Crystalline resin 1 | 91 | 85% | PES1 | 105 |
| 2-9 | Crystalline resin 1 | 91 | 85% | PES1 | 105 |
| 2-10 | Crystalline resin 3 | 64 | 85% | PES1 | 105 |

※The addition amount of release-agent is a weight-ratio to resin for shell.
The mark "*" means a weight ratio to resin for core (solids).

In each of the examples and comparative examples, in addition to the cyan toner particles, magenta toner particles, yellow toner particles and black toner particles were also obtained by carrying out the same processes as the manufacturing method of the cyan toner particles except that magenta colorant dispersion solution M1, yellow colorant dispersion solution Y1 and black colorant dispersion solution K1 were respectively used in place of cyan colorant dispersion solution C1.

(Production of Toner)

To the resulting toner particles were added 0.8% by weight of hydrophobic silica (H2000, 15 nm: made by Hoechst Japan Limited) and 0.4% by weight of hydrophobic titania (STT30A, 30 nm: made by Titan Kogyo K.K.) as external additive agents, and this was mixed by a Henschel mixer so as to carry out addition processes; thus, a toner was obtained.

TABLE 2-3

| | | Core | | | | | | | | | | | | | |
|---|---|---|---|---|---|---|---|---|---|---|---|---|---|---|---|
| | | Resin A | | | Resin B | | | Wax 1 | | | | Wax 2 | | | |
| | | Resin | Softening point (° C.) | Content (weight ratio to total core resin) | Resin | Softening point (° C.) | Content (weight ratio to total core resin) | Kind | Trade name | Softening point (° C.) | Addition amount | Kind | Trade name | Softening point (° C.) | Addition amount |
| Comparative example | 2-1 | PES2 | 108 | 15% | Crystalline resin1 | 91 | 85% | Ester wax | WEP-5RF | 82 | 15%* | — | — | — | — |
| | 2-2 | — | — | — | — | — | — | Ester wax | WEP-5RF | 82 | 30% | PE | Neowax LS | 110 | 30% |
| | 2-3 | — | — | — | — | — | — | Ester wax | WEP-5RF | 82 | 30% | PE | Neowax LS | 110 | 30% |
| | 2-4 | — | — | — | — | — | — | Ester wax | WEP-5RF | 82 | 30% | PE | Neowax LS | 110 | 30% |
| | 2-5 | — | — | — | — | — | — | Ester wax | WEP-5RF | 82 | 30% | PE | Neowax LS | 110 | 30% |
| | 2-6 | — | — | — | — | — | — | PE | Neowax LS | 110 | 60% | — | — | — | — |

※The addition of release-agent is a weight-ratio to resin for shell.
The mark "*" means a weight ratio to resin for core (solids).

TABLE 2-4

| | | Shell | | | | |
|---|---|---|---|---|---|---|
| | | Crystalline PES | | | Amorphous resin 1 | |
| | | Resin | Softening point (° C.) | Content (resin ratio for shell, wt %) | Resin | Softening point (° C.) |
| Comparative example | 2-1 | — | — | — | — | — |
| | 2-2 | — | — | — | PES1 | 105 |
| | 2-3 | Crystalline resin 1 | 91 | 60% | PES1 | 105 |
| | 2-4 | Crystalline resin 4 | 51 | 85% | PES1 | 105 |
| | 2-5 | Crystalline resin 5 | 125 | 85% | PES1 | 105 |
| | 2-6 | Crystalline resin 1 | 91 | 85% | PES1 | 105 |

※The addition amount of release-agent is a weight-ratio to resin for shell.
The mark "*" means a weight ratio to resin for core (solids).

(Evaluation of Toner)

<Heat-resistant Storing Property>

Cyan toner (20 g) was put into a glass bottle of 50 ml, and after having been left at a high temperature of 50° C. for 24 hours, the toner was visually observed to evaluate the heat resistant storing property.

○: There were no aggregated toner particles, causing no problem.

Δ: Soft aggregation was slightly observed, but easily crumbled with a slight force, causing no problems in practical use.

x: Firmly aggregated clumps were observed, and hardly crumbled to cause serious problems in practical use.

The toners having four colors, obtained from the respective examples or comparative examples, are loaded into an actual machine, and evaluated. A color laser printer (magicolor 2300 DL; made by Minolta-QMS Co., Ltd.) was used.

<Fixing Property; Non-offset Temperature Width>

The fixing device of the machine is modified so as to desirably set the fixing temperature thereof. By changing the temperature of the fixing roller, a solid image having superposed three colors (Y, M and C) with a total amount of adhesion of 15 g/m$^2$ was outputted with respect to the low-temperature side. A mono-color gradation image with an amount of adhesion of 0 to 5.0 g/m$^2$ was outputted for each of the colors, with respect to the high-temperature side. Thus, each image on paper after passing through the fixing roller was observed. In each of the images, evaluation was made based upon a fixing temperature width (non-offset temperature width) in which neither low-temperature offset nor high-temperature offset occurred. With respect to the paper, CF paper (basis weight 80 g/m$^2$), which is standard paper for use in CF900, was used. Images having even a slight offset were evaluated as "defective."

○: Non-offset temperature width was wider than 40° C.

Δ: Non-offset temperature width was from not less than 30° C. to less than 40° C.

x: Non-offset temperature width is less than 30° C.

<Low-temperature Fixing Property; Bending Test>

The copied image, fixed on copy paper at 130° C. in the above-mentioned evaluation method of the non-offset temperature range, was folded into two from the middle portion, and the separating property thereof was visually observed.

◎: No surface separation, such as separations with exposed medium and image surface separations without exposed medium, occurred on the image, causing no problems in practical use.

○: Although no separation with exposed medium occurred, surface separation occurred.

Δ: Line-shaped separations with exposed medium occurred, causing problems in practical use.

x: Separations with exposed medium occurred over a wide range, causing problems in practical use.

<Durability (Anti-breaking Property)>

In the evaluation processes, endurance test processes of 2000 sheets of white paper were carried out under L/L environments (10° C., 15%) and the toner to be evaluated was then taken out. The toner particles were observed under a reflection-type electronic microscope at a magnification of ×1000, five times with the viewing field being changed; thus, the average number of broken toner particles was found in 500 toner particles. The evaluation was made based upon the following criteria.

○: No broken toner particles were found, causing no problems in practical use.

Δ: Although 1 to 9 broken toner particles were present, no problems were raised in practical use.

x: Not less than 10 broken toner particles were present, causing problems in practical use.

<Anti-filming Property (Including BS Property)>

With respect to the printer, conditions on the photosensitive member and the intermediate transferring member were visually observed respectively after the initial process under L/L environments and after the initial process under N/N environments (23° C., 45%) as well as after continuous copying processes of 2000 sheets (after endurance tests). The continuous copying processes were carried out under a condition of C/W ratio of 6% using a predetermined print pattern.

○: Neither filming nor BS occurred on any of the photosensitive member and the intermediate transferring member.

Δ: Filming and BS occurred on either of the photosensitive member and the intermediate transferring member; however, no problem occurred on the image, causing no problems in practical use.

x: Filming and BS occurred on at least either of the photosensitive member and the intermediate transferring member, and the resulting adverse effects were observed on the image, causing problems in practical use.

<Image Storing Property>

Continuous copying processes for 10 sheets were carried out under a condition of C/W ratio of 6% using a predetermined print pattern. The copying processes were double sided copying processes. Ten sheets of the resulting images were superposed and stored at 50° C. for 24 hours. The conditions after the storage were visually observed and evaluated.

○: No adhered images were found, causing no problems in practical use.

x: Adhered images were found, and image losses occurred when separated, causing problems in practical use.

TABLE 2-5

| | Result of evaluation General | | | | | |
|---|---|---|---|---|---|---|
| | Low-temperature fixing property | Non-offset temperature width | Heat-resistant storing property | Image storing property | Anti-breaking property | Anti-filming |
| Ex. 2-1 | ◎ | ○ | ○ | ○ | Δ | ○ |
| Ex. 2-2 | ◎ | ○ | ○ | ○ | Δ | ○ |
| Ex. 2-3 | ◎ | ○ | ○ | ○ | Δ | ○ |
| Ex. 2-4 | ◎ | ○ | ○ | ○ | Δ | ○ |
| Ex. 2-5 | ◎ | ○ | ○ | ○ | Δ | ○ |

TABLE 2-5-continued

| | Result of evaluation General | | | | | |
|---|---|---|---|---|---|---|
| | Low-temperature fixing property | Non-offset temperature width | Heat-resistant storing property | Image storing property | Anti-breaking property | Anti-filming |
| Ex. 2-6 | ◎ | ○ | ○ | ○ | Δ | ○ |
| Ex. 2-7 | ◎ | Δ | ○ | ○ | Δ | ○ |
| Ex. 2-8 | ◎ | ○ | Δ | ○ | Δ | ○ |
| Ex. 2-9 | ◎ | Δ | ○ | ○ | Δ | ○ |
| Ex. 2-10 | ◎ | Δ | ○ | ○ | Δ | ○ |
| Com. ex. 2-1 | ○ | Δ | X | ○ | X | X |
| Com. ex. 2-2 | X | X | X | ○ | ○ | ○ |
| Com. ex. 2-3 | Δ | X | ○ | ○ | X | X |
| Com. ex. 2-4 | ○ | X | X | X | X | X |
| Com. ex. 2-5 | X | X | ○ | ○ | ○ | ○ |
| Com. ex. 2-6 | ○ | ○ | ○ | ○ | X | X |

(Production 3 of Toner Particles)

Example 3-1

(Formation of Core Particles)

To a four-neck flask equipped with a thermometer, a cooling pipe and a stirring device were loaded 500 g of PES 2 dispersion solution and 6.4 g of anionic surfactant (Newlex R: made by NOF Corporation), and stirred at 280 rpm for 40 minutes. To this was further added 48 g of colorant dispersion solution C1, and the pH thereof was adjusted to 10 by using 1N NaOH aqueous solution. To this was dripped 80 g of 10 wt % magnesium chloride aqueous solution in 10 minutes, and this was then abruptly heated to 56° C. and held at this temperature for 2 hours.

(Formation of Intermediate Layer)

To the resulting dispersion solution was further added 75 g of release agent dispersion solution 1 gradually, and held as it was for one hour.

(Formation of Shell Layer)

A small amount of the resulting dispersion solution was sampled and separated by a centrifugal separator, and after having confirmed that the supernatant became transparent, a mixed dispersion solution, prepared by preliminarily mixing 64g of crystalline resin 1 dispersion solution and 11 g of PES 1 dispersion solution, was gradually added to the system, and then heated to 85° C., and maintained for one hour. A small amount of the resulting dispersion solution was sampled and separated by a centrifugal separator, and after having confirmed that the supernatant became transparent, 4.8 g of anionic surfactant (Newlex R: made by NOF Corporation) was added thereto at once. Thereafter, this was heated to 94° C. and maintained at this temperature for one hour. This was cooled, washed and dried to obtain toner particles. The toner particles had a particle size of 5.1 μm and a degree of roundness of 0.990.

Example 3-2

The same processes as example 3-1 were carried out except that 75 g of crystalline resin 1 dispersion solution was used without using PES 1 dispersion solution to prepare toner particles. The toner particles had a particle size of 5.1 μm and a degree of roundness of 0.990.

Example 3-3

The same processes as example 3-1 were carried out except that the amount of crystalline resin 1 dispersion solution was changed to 54 g, with the amount of PES 1 dispersion solution being changed to 21 g, to prepare toner particles. The toner particles had a particle size of 5.1 μm and a degree of roundness of 0.990.

Example 3-4

The same processes as example 3-1 were carried out except that crystalline resin 1 dispersion solution was changed to crystalline resin 2 dispersion solution, with PES 2 dispersion solution being changed to PES 3 dispersion solution, and that the shell-forming temperature was changed from 85° C. being changed to 90° C., to prepare toner particles. The toner particles had a particle size of 5.1 μm and a degree of roundness of 0.990.

Example 3-5

The same processes as example 3-1 were carried out except that crystalline resin 1 dispersion solution was changed to crystalline resin 3 dispersion solution, with release agent dispersion solution 1 being changed to release agent dispersion solution 2, and that the shell-forming temperature was changed from 85° C. to 62° C., to prepare toner particles. The toner particles had a particle size of 5.1 μm and a degree of roundness of 0.992.

Example 3-6

The same processes as example 3-1 were carried out except that 64 g of crystalline resin 1 dispersion solution was changed to 71 g of crystalline resin 3 dispersion solution, with the weight of PES 1 dispersion solution being changed from 11 g to 4 g, and that release agent dispersion solution 1 was changed to release agent dispersion solution 2, with the shell-forming temperature being changed from 85° C. being changed to 62° C., to prepare toner particles. The toner particles had a particle size of 5.1 μm and a degree of roundness of 0.992.

Example 3-7

The same processes as example 3-5 were carried out except that release agent dispersion solution 2 was changed to release agent dispersion solution 1 to prepare toner particles. The toner particles had a particle size of 5.1 μm and a degree of roundness of 0.992.

Example 3-8

The same processes as example 3-4 were carried out except that release agent dispersion solution 1 was changed to release agent dispersion solution 3 to prepare toner particles. The toner particles had a particle size of 5.1 μm and a degree of roundness of 0.992.

Comparative Example 3-1

To a four-neck flask equipped with a thermometer, a cooling pipe and a stirring device were loaded 75 g of PES 2 dispersion solution, 425 g of crystalline resin 1 dispersion solution and 6.4 g of anionic surfactant (Newlex R: made by NOF Corporation), and stirred at 280 rpm for 40 minutes. To this were further added 75 g of release agent dispersion solution 1 and 48 g of colorant dispersion solution C1, and the pH thereof was adjusted to 10 by using 1N NaOH aqueous solution. To this was dripped 80 g of 10 wt % magnesium chloride aqueous solution in 10 minutes, and this was then abruptly heated to 56° C. and held at this temperature for 2 hours.

To this was added 4.8 g of anionic surfactant (Newlex R: made by NOF Corporation) at once. Thereafter, this was heated to 92° C. and maintained at this temperature for one hour. This was cooled, washed and dried to obtain toner particles. The toner particles had a particle size of 5.8 μm and a degree of roundness of 0.982.

Comparative Example 3-2

(Formation of Core Particles)

To a four-neck flask equipped with a thermometer, a cooling pipe and a stirring device were loaded 500 g of PES 2 dispersion solution and 6.4 g of anionic surfactant (Newlex R: made by NOF Corporation), and stirred at 280 rpm for 40 minutes. To this was further added 48 g of colorant dispersion solution C1, and the pH thereof was adjusted to 10 by using 1N NaOH aqueous solution. To this was dripped 80 g of 10 wt % magnesium chloride aqueous solution in 10 minutes, and this was then abruptly heated to 56° C. and held at this temperature for 2 hours.

(Formation of Intermediate Layer)

To the resulting dispersion solution was further added 75 g of release agent dispersion solution 1, and maintained, as it was, for one hour.

(Formation of Shell Layer)

A small amount of the resulting dispersion solution was sampled and separated by a centrifugal separator, and after having confirmed that the supernatant became transparent, 75 g of PES 1 dispersion solution was gradually added to the system, and the system was then heated to 85° C., and maintained for one hour. A small amount of the resulting dispersion solution was sampled and separated by a centrifugal separator, and after having confirmed that the supernatant became transparent, 4.8 g of anionic surfactant (Newlex R: made by NOF Corporation) was added thereto at once. Thereafter, this was heated to 94° C. and maintained at this temperature for one hour. This was cooled, washed and dried to obtain toner particles. The toner particles had a particle size of 5.4 μm and a degree of roundness of 0.984.

Comparative Example 3-3

The same processes as example 3-1 were carried out except that 64 g of crystalline resin 1 dispersion solution was changed to 45 g, with 11 g of PES 1 dispersion solution being changed to 30 g, to prepare toner particles. The toner particles had a particle size of 5.0 μm and a degree of roundness of 0.988.

Comparative Example 3-4

(Formation of Core Particles)

To a four-neck flask equipped with a thermometer, a cooling pipe and a stirring device were loaded 500 g of PES 2 dispersion solution and 6.4 g of anionic surfactant (Newlex R: made by NOF Corporation), and stirred at 280 rpm for 40 minutes. To this was further added 48 g of colorant dispersion solution C1, and the pH thereof was adjusted to 10 by using 1N NaOH aqueous solution. To this was dripped 80 g of 10 wt % magnesium chloride aqueous solution in 10 minutes, and this was then abruptly heated to 56° C. and held at this temperature for 2 hours. This was temporarily cooled to 50° C.

(Formation of Intermediate Layer)

To the resulting dispersion solution was further added 75 g of release agent dispersion solution 1 gradually, and maintained, as it was, for one hour.

(Formation of Shell Layer)

A small amount of the resulting dispersion solution was sampled and separated by a centrifugal separator, and after having confirmed that the supernatant became transparent, a mixed dispersion solution, prepared by preliminarily mixing 64 g of crystalline resin 4 dispersion solution and 11 g of PES 1 dispersion solution, was gradually added to the system, and the system was maintained, as it was, for one hour. A small amount of the resulting dispersion solution was sampled and separated by a centrifugal separator, and after having confirmed that the supernatant became transparent, 4.8 g of anionic surfactant (Newlex R: made by NOF Corporation) was added thereto at once. Thereafter, this was heated to 55° C. and maintained at this temperature for one hour. This was cooled, washed and dried to obtain toner particles. The toner particles had a particle size of 5.9 μm and a degree of roundness of 0.980.

Comparative Example 3-5

(Formation of Core Particles)

To a four-neck flask equipped with a thermometer, a cooling pipe and a stirring device were loaded 500 g of PES 2 dispersion solution and 6.4 g of anionic surfactant (Newlex R: made by NOF Corporation), and stirred at 280 rpm for 40 minutes. To this was further added 48 g of colorant dispersion solution C1, and the pH thereof was adjusted to 10 by using 1N NaOH aqueous solution. To this was dripped 80 g of 10 wt % magnesium chloride aqueous solution in 10 minutes, and this was then abruptly heated to 56° C. and held at this temperature for 2 hours.

(Formation of Intermediate Layer)

To the resulting dispersion solution was further added 75 g of release agent dispersion solution 1 gradually, and maintained, as it was, for one hour.

(Formation of Shell Layer)

A small amount of the resulting dispersion solution was sampled and separated by a centrifugal separator, and after having confirmed that the supernatant became transparent, a mixed dispersion solution, prepared by preliminarily mixing 64 g of crystalline resin 5 dispersion solution and 11 g of PES 1 dispersion solution, was gradually added to the system, and the system was heated to 95° C., and maintained, as it was, for one hour. A small amount of the resulting dispersion solution was sampled and separated by a centrifugal separator, and after having confirmed that the supernatant became transparent, 4.8 g of anionic surfactant (Newlex R: made by NOF Corporation) was added thereto at once. Thereafter, this was maintained for one hour. This was cooled, washed and dried to obtain toner particles. The toner particles had a particle size of 6.2 μm and a degree of roundness of 0.984.

Comparative Example 3-6

(Formation of Core Particles)

To a four-neck flask equipped with a thermometer, a cooling pipe and a stirring device were loaded 500 g of PES 2 dispersion solution and 6.4 g of anionic surfactant (Newlex R: made by NOF Corporation), and stirred at 280 rpm for 40 minutes. To this were further added 25 g of release agent dispersion solution 1 and 48 g of colorant dispersion solution C1, and the pH thereof was adjusted to 10 by using 1N NaOH aqueous solution. To this was dripped 80 g of 10 wt % magnesium chloride aqueous solution in 10 minutes, and this was then abruptly heated to 56° C. and held at this temperature for 2 hours.

(Formation of Shell Layer)

Crystalline resin 1 dispersion solution (64 g), PES 1 dispersion solution (11 g) and release agent dispersion solution 1 (50) were preliminarily mixed, and after the resulting mixed dispersion solution had been gradually added to the system, the system was heated to 85° C. and maintained for one hour. A small amount of the resulting dispersion solution was sampled and separated by a centrifugal separator, and after having confirmed that the supernatant became transparent, 4.8 g of anionic surfactant (Newlex R: made by NOF Corporation) was added thereto at once. Thereafter, this was heated to 94° C. and maintained at this temperature for one hour. This was cooled, washed and dried to obtain toner particles. The toner particles had a particle size of 6.2 μm and a degree of roundness of 0.982.

Comparative Example 3-7

(Formation of Core Particles)

To a four-neck flask equipped with a thermometer, a cooling pipe and a stirring device were loaded 400 g of PES 2 dispersion solution, 100 g of crystalline resin 1 dispersion solution and 6.4 g of anionic surfactant (Newlex R: made by NOF Corporation), and stirred at 280 rpm for 40 minutes. To this were further added 48 g of colorant dispersion solution C1, and the pH thereof was adjusted to 10 by using 1N NaOH aqueous solution. To this was dripped 80 g of 10 wt % magnesium chloride aqueous solution in 10 minutes, and this was then abruptly heated to 56° C. and held at this temperature for 2 hours.

(Formation of Intermediate Layer)

To the resulting dispersion solution was further added 75 g of release agent dispersion solution 1 gradually, and maintained, as it was, for one hour.

(Formation of Shell Layer)

A small amount of the resulting dispersion solution was sampled and separated by a centrifugal separator, and after having confirmed that the supernatant became transparent, 75 g of PES 1 dispersion solution was gradually added to the system, and the system was then heated to 85° C., and maintained for one hour. A small amount of the resulting dispersion solution was sampled and separated by a centrifugal separator, and after having confirmed that the supernatant became transparent, 4.8 g of anionic surfactant (Newlex R: made by NOF Corporation) was added thereto at once. Thereafter, this was heated to 94° C., and maintained for one hour. This was cooled, washed and dried to obtain toner particles. The toner particles had a particle size of 5.8 μm and a degree of roundness of 0.980.

Comparative Example 3-8

(Formation of Core Particles)

To a four-neck flask equipped with a thermometer, a cooling pipe and a stirring device were loaded 500 g of PES 2 dispersion solution and 6.4 g of anionic surfactant (Newlex R: made by NOF Corporation), and stirred at 280 rpm for 40 minutes. To this were further added 75 g of release agent dispersion solution 1 and 48 g of colorant dispersion solution C1, and the pH thereof was adjusted to 10 by using 1N NaOH aqueous solution. To this was dripped 80 g of 10 wt % magnesium chloride aqueous solution in 10 minutes, and this was then abruptly heated to 56° C. and held at this temperature for 2 hours.

(Formation of Intermediate Layer)

To the resulting dispersion solution was further added 75 g of PES 2 dispersion solution gradually, and maintained, as it was, for one hour.

(Formation of Shell Layer)

A small amount of the resulting dispersion solution was sampled and separated by a centrifugal separator, and after having confirmed that the supernatant became transparent, a mixed dispersion solution, prepared by preliminarily mixing 64 g of crystalline resin 1 dispersion solution and 11 g of PES 1 dispersion solution, was added to the system gradually, and the system was then heated to 85° C., and maintained for one hour. A small amount of the resulting dispersion solution was sampled and separated by a centrifugal separator, and after having confirmed that the supernatant became transparent, 4.8 g of anionic surfactant (Newlex R: made by NOF Corporation) was added thereto at once. Thereafter, this was heated to 94° C., and maintained for one hour. This was cooled, washed and dried to obtain toner particles. The toner particles had a particle size of 5.4 μm and a degree of roundness of 0.990.

TABLE 3-1

| | | Intermediate layer | | | | | | Core | | | | | | | | | |
|---|---|---|---|---|---|---|---|---|---|---|---|---|---|---|---|---|---|
| | | | | | | | | Resin A | | | Resin B | | | | | | |
| | | Resin | | Wax | | | | | | Content (weight | | | Content (weight | Wax 1 | | | |
| | | Resin | Softening point (° C.) | Kind | Trade name | Softening point (° C.) | Addition amount | Resin | Softening point (° C.) | ratio to total core resin) | Resin | Softening point (° C.) | ratio to total core resin) | Kind | Trade name | Softening point (° C.) | Addition amount |
| Example | 3-1 | — | — | Ester Wax | WEP-5RF | 82 | 15% | PES2 | 108 | 100% | — | — | — | — | — | — | — |
| | 3-2 | — | — | Ester Wax | WEP-5RF | 82 | 15% | PES2 | 108 | 100% | — | — | — | — | — | — | — |
| | 3-3 | — | — | Ester Wax | WEP-5RF | 82 | 15% | PES2 | 108 | 100% | — | — | — | — | — | — | — |
| | 3-4 | — | — | Ester Wax | WEP-5RF | 82 | 15% | PES3 | 119 | 100% | — | — | — | — | — | — | — |
| | 3-5 | — | — | Ester Wax | WE-2 | 60 | 15% | PES2 | 108 | 100% | — | — | — | — | — | — | — |
| | 3-6 | — | — | Ester Wax | WE-2 | 60 | 15% | PES2 | 108 | 100% | — | — | — | — | — | — | — |
| | 3-7 | — | — | Ester Wax | WEP-5RF | 82 | 15% | PES2 | 108 | 100% | — | — | — | — | — | — | — |
| | 3-8 | — | — | PE | Neowax LS | 110 | 15% | PES2 | 108 | 100% | — | — | — | — | — | — | — |

※The addition amount of release-agent is a weight ratio to resin for core (solids) in any case of addition to core, addition to intermediate layer and addition to shell layer.

TABLE 3-2

| | | Shell | | | | | | | | |
|---|---|---|---|---|---|---|---|---|---|---|
| | | Crystalline PES | | | Amorphous resin 1 | | Wax | | | |
| | | Resin | Softening point (° C.) | Content (resin ratio for shell, wt %) | Resin | Softening point (° C.) | Kind | Trade name | Softening point (° C.) | Addition amount |
| Example | 3-1 | Crystalline resin 1 | 91 | 85% | PES1 | 105 | — | — | — | — |
| | 3-2 | Crystalline resin 1 | 91 | 100% | — | — | — | — | — | — |
| | 3-3 | Crystalline resin 1 | 91 | 72% | PES1 | 105 | — | — | — | — |
| | 3-4 | Crystalline resin 2 | 117 | 85% | PES1 | 105 | — | — | — | — |
| | 3-5 | Crystalline resin 3 | 64 | 85% | PES1 | 105 | — | — | — | — |
| | 3-6 | Crystalline resin 3 | 64 | 95% | PES1 | 105 | — | — | — | — |
| | 3-7 | Crystalline resin 3 | 64 | 85% | PES1 | 105 | — | — | — | — |
| | 3-8 | Crystalline resin 2 | 117 | 85% | PES1 | 105 | — | — | — | — |

※The addition amount of release-agent is a weight ratio to resin for core (solids) in any case of addition to core, addition to intermediate layer and addition to shell layer.

TABLE 3-3

| | | Intermediate layer | | | | | | Core Resin A | | |
|---|---|---|---|---|---|---|---|---|---|---|
| | | Resin | | Wax | | | | | | Content (weight |
| | | Resin | Softening point (° C.) | Kind | Trade name | Softening point (° C.) | Addition amount | Resin | Softening point (° C.) | ratio to total core resin) |
| Comparative example | 3-1 | — | — | — | — | — | — | PES2 | 108 | 15% |

TABLE 3-3-continued

| | | | | | | | | | |
|---|---|---|---|---|---|---|---|---|---|
| 3-2 | — | — | Ester wax | WEP-5RF | 82 | 15% | PES2 | 108 | 100% |
| 3-3 | — | — | Ester wax | WEP-5RF | 82 | 15% | PES2 | 108 | 100% |
| 3-4 | — | — | Ester wax | WEP-5RF | 82 | 15% | PES2 | 108 | 100% |
| 3-5 | — | — | Ester wax | WEP-5RF | 82 | 15% | PES2 | 108 | 100% |
| 3-6 | — | — | — | — | — | — | PES2 | 108 | 100% |
| 3-7 | — | — | Ester wax | WEP-5RF | 82 | 15% | PES2 | 108 | 80% |
| 3-8 | PES2 | 108 | — | — | — | — | PES2 | 108 | 100% |

| | | Core | | | | | | |
|---|---|---|---|---|---|---|---|---|
| | | Resin B | | | Wax 1 | | | |
| | | Resin | Softening point (° C.) | Content (weight ratio to total core resin) | Kind | Trade name | Softening point (° C.) | Addition amount |
| Comparative example | 3-1 | Crystalline resin 1 | 91 | 85% | Ester wax | WEP-5RF | 82 | 15% |
| | 3-2 | — | — | — | — | — | — | — |
| | 3-3 | — | — | — | — | — | — | — |
| | 3-4 | — | — | — | — | — | — | — |
| | 3-5 | — | — | — | — | — | — | — |
| | 3-6 | — | — | — | Ester wax | WEP-5RF | 82 | 5% |
| | 3-7 | Crystalline resin 1 | 91 | 20% | — | — | — | — |
| | 3-8 | — | — | — | Ester wax | WEP-5RF | 82 | 15% |

※The addition amount of release-agent is a weight ratio to resin for core (solids) in any case of addition to core, addition to intermediate layer and addition to shell layer.

TABLE 3-4

| | | Shell | | | | | | | | |
|---|---|---|---|---|---|---|---|---|---|---|
| | | Crystalline PES | | | Amorphous resin 1 | | Wax | | | |
| | | Resin | Softening point (° C.) | Content (resin ratio for shell, wt %) | Resin | Softening point (° C.) | Kind | Trade name | Softening point (° C.) | Addition amount |
| Comparative example | 3-1 | — | — | — | — | — | — | — | — | — |
| | 3-2 | — | — | — | PES1 | 105 | — | — | — | — |
| | 3-3 | Crystalline resin 1 | 91 | 60% | PES1 | 105 | — | — | — | — |
| | 3-4 | Crystalline resin 4 | 51 | 85% | PES1 | 105 | — | — | — | — |
| | 3-5 | Crystalline resin 5 | 125 | 85% | PES1 | 105 | — | — | — | — |
| | 3-6 | Crystalline resin 1 | 91 | 85% | PES1 | 105 | Ester wax | WEP-5RF | 82 | 10% |
| | 3-7 | — | — | — | PES1 | 105 | — | — | — | — |
| | 3-8 | Crystalline resin 1 | 91 | 85% | PES1 | 105 | — | — | — | — |

※The addition amount of release-agent is a weight ratio to resin for core (solids) in any case of addition to core, addition to intermediate layer and addition to shell layer.

In each of the examples and comparative examples, in addition to the cyan toner particles, magenta toner particles, yellow toner particles and black toner particles were also obtained by carrying out the same processes as the manufacturing method of the cyan toner particles except that magenta colorant dispersion solution M1, yellow colorant dispersion solution Y1 and black colorant dispersion solution K1 were respectively used in place of cyan colorant dispersion solution C1.

(Production of Toner)

To the resulting toner particles were added 0.8% by weight of hydrophobic silica (H2000, 15 nm: made by Hoechst Japan Limited) and 0.4% by weight of hydrophobic titania (STT30A, 30 nm: made by Titan Kogyo K.K.) as external additive agents, and this was mixed by a Henschel mixer so as to carry out addition processes; thus, a toner was obtained.

(Evaluation of Toner)

<Heat-resistant Storing Property>

Cyan toner (20 g) was put into a glass bottle of 50 ml, and after having been left at a high temperature of 50° C. for 24 hours, the toner was visually observed to evaluate the heat resistant storing property.

○: There were no aggregated toner particles, causing no problem.

Δ: Soft aggregation was slightly observed, but easily crumbled with a slight force, causing no problems in practical use.

x: Firmly aggregated clumps were observed, and hardly crumbled to cause serious problems in practical use.

The toners having four colors, obtained from the respective examples or comparative examples, were loaded into an actual machine, and evaluated. A color laser printer (magicolor 2300 DL; made by Minolta-QMS Co., Ltd.) having a transferring mechanism and a fixing mechanism in a separate manner was used to carry out the following evaluations.

<Fixing Property; Non-offset Temperature Range>

The fixing device of the machine is modified so as to desirably set the fixing temperature thereof. By changing the temperature of the fixing roller, a solid image having superposed three colors (Y, M and C) with a total amount of adhesion of 15 g/m$^2$ was outputted with respect to the low-temperature side. A mono-color gradation image with an amount of adhesion of 0 to 5.0 g/m$^2$ was outputted for each of the colors, with respect to the high-temperature side. Thus, each image on paper after passing through the fixing roller was observed. In each of the images, evaluation was made based upon a fixing temperature width (non-offset temperature width) in which neither low-temperature offset nor high-temperature offset occurred. With respect to the paper, CF paper (basis weight 80 g/m$^2$), which is standard paper for use in CF900, was used. Images having even a slight offset were evaluated as "defective."

○: Non-offset temperature width was wider than 40° C.

Δ: Non-offset temperature width was from not less than 30° C. to less than 40° C.

x: Non-offset temperature width was less than 30° C.

<Low-temperature Fixing Property; Bending Test>

The copied image, fixed on copy paper at 130° C. in the above-mentioned evaluation method of the non-offset temperature range, was folded into two from the middle portion, and the separating property thereof was visually observed.

○: No separation occurred on the image, causing no problems in practical use.

Δ: Although slight separation occurred on the image, no problems were raised in practical use.

x: Many separations occurred on the image, causing problems in practical use.

<Durability (Anti-breaking Property)>

In the evaluation processes, endurance test processes of 2000 sheets of white paper were carried out under L/L environments (10° C., 15%) and the toner to be evaluated was then taken out. The toner particles were observed under a reflection-type electronic microscope at a magnification of ×1000, five times with the viewing field being changed; thus, the average number of broken toner particles was found in 500 toner particles. The evaluation was made based upon the following criteria.

○: No broken toner particles were found, causing no problems in practical use.

Δ: Although 1 to 9 broken toner particles were present, no problems were raised in practical use.

x: Not less than 10 broken toner particles were present, causing problems in practical use.

<Anti-filming Property (Including BS Property)>

Conditions on the photosensitive member and the intermediate transferring member were visually observed respectively after the initial process under L/L environments and after the initial process under N/N environments (23° C., 45%) as well as after continuous copying processes of 2000 sheets (after endurance tests). The continuous copying processes were carried out under a condition of C/W ratio of 6% using a predetermined print pattern.

○: Neither filming nor BS occurred on any of the photosensitive member and the intermediate transferring member.

Δ: Filming and BS occurred on either of the photosensitive member and the intermediate transferring member; however, no problem occurred on the image, causing no problems in practical use.

x: Filming and BS occurred on at least either of the photosensitive member and the intermediate transferring member, and the resulting adverse effects were observed on the image, causing problems in practical use.

<Image Storing Property>

Continuous copying processes for 10 sheets were carried out under a condition of C/W ratio of 6% using a predetermined print pattern. The copying processes were double sided copying processes. Ten sheets of the resulting images were superposed and stored at 50° C. for 24 hours. The conditions after the storage were visually observed and evaluated.

○: No adhered images were found, causing no problems in practical use.

x: Adhered images were found, and image losses occurred when separated, causing problems in practical use.

TABLE 3-5

| | Result of evaluation General | | | | | |
|---|---|---|---|---|---|---|
| | Low-temperature fixing property | Non-offset temperature width | Heat-resistant storing property | Image storing property | Anti-breaking property | Anti-filming |
| Ex. 3-1 | ○ | ○ | ○ | ○ | ○ | ○ |
| Ex. 3-2 | ○ | ○ | ○ | ○ | Δ | ○ |
| Ex. 3-3 | ○ | ○ | ○ | ○ | ○ | ○ |

TABLE 3-5-continued

| | Result of evaluation General | | | | | |
|---|---|---|---|---|---|---|
| | Low-temperature fixing property | Non-offset temperature width | Heat-resistant storing property | Image storing property | Anti-breaking property | Anti-filming |
| Ex. 3-4 | ○ | ○ | ○ | ○ | ○ | ○ |
| Ex. 3-5 | ○ | ○ | ○ | ○ | ○ | ○ |
| Ex. 3-6 | ○ | ○ | ○ | ○ | ○ | ○ |
| Ex. 3-7 | ○ | Δ | ○ | ○ | ○ | ○ |
| Ex. 3-8 | ○ | ○ | Δ | ○ | Δ | ○ |
| Com. ex. 3-1 | ○ | Δ | X | ○ | X | X |
| Com. ex. 3-2 | X | X | X | ○ | ○ | ○ |
| Com. ex. 3-3 | Δ | X | ○ | ○ | X | X |
| Com. ex. 3-4 | ○ | X | X | X | X | X |
| Com. ex. 3-5 | X | X | ○ | ○ | ○ | ○ |
| Com. ex. 3-6 | ○ | ○ | X | ○ | Δ | X |
| Com. ex. 3-7 | X | X | X | ○ | ○ | ○ |
| Com. ex. 3-8 | ○ | X | ○ | ○ | ○ | ○ |

(Production 4 of Toner Particles)

Example 4-1

(Formation of Core Particles)

To a four-neck flask equipped with a thermometer, a cooling pipe and a stirring device were loaded 500 g of PES 2 dispersion solution and 6.4 g of anionic surfactant (Newlex R: made by NOF Corporation), and stirred at 280 rpm for 40 minutes. To this were further added 75 g of release agent dispersion solution 1 and 48 g of colorant dispersion solution C1, and the pH thereof was adjusted to 10 by using 1N NaOH aqueous solution. To this was dripped 80 g of 10 wt % magnesium chloride aqueous solution in 10 minutes, and this was then abruptly heated to 56° C. and held at this temperature for 2 hours.

(Formation of Shell Layer)

A mixed dispersion solution, prepared by preliminarily mixing 64 g of crystalline resin 1 dispersion solution and 11 g of urea-modified PES 1 dispersion solution, was gradually added to the system, and then heated to 85° C., and maintained for one hour. A small amount of the resulting dispersion solution was sampled and separated by a centrifugal separator, and after having confirmed that the supernatant became transparent, 4.8 g of anionic surfactant (Newlex R: made by NOF Corporation) was added thereto at once. Thereafter, this was heated to 94° C. and maintained at this temperature for one hour. This was cooled, washed and dried to obtain toner particles. The toner particles had a particle size of 5.2 μm and a degree of roundness of 0.988.

Example 4-2

The same processes as example 4-1 were carried out except that the weight of crystalline resin 1 dispersion solution was changed to 71 g, with the weight of urea-modified PES 1 dispersion solution being changed to 4 g, to prepare toner particles. The toner particles had a particle size of 5.4 μm and a degree of roundness of 0.992.

Example 4-3

The same processes as example 4-1 were carried out except that the weight of crystalline resin 1 dispersion solution was changed to 54 g, with the weight of urea-modified PES 1 dispersion solution being changed to 21 g, to prepare toner particles. The toner particles had a particle size of 5.4 μm and a degree of roundness of 0.988.

Example 4-4

The same processes as example 4-1 were carried out except that crystalline resin 1 dispersion solution was changed to crystalline resin 2 dispersion solution, with PES 2 dispersion solution being changed to PES 3 dispersion solution, and that the shell-forming temperature was changed from 85° C. being changed to 90° C., to prepare toner particles. The toner particles had a particle size of 5.6 μm and a degree of roundness of 0.986.

Example 4-5

The same processes as example 4-1 were carried out except that crystalline resin 1 dispersion solution was changed to crystalline resin 3 dispersion solution, with release agent dispersion solution 1 being changed to release agent dispersion solution 2, and that the shell-forming temperature was changed from 85° C. to 62° C., to prepare toner particles. The toner particles had a particle size of 5.8 μm and a degree of roundness of 0.988.

Example 4-6

(Formation of Core Particles)

To a four-neck flask equipped with a thermometer, a cooling pipe and a stirring device were loaded 450 g of PES 2 dispersion solution, 50 g of urea-modified PES 2 dispersion solution and 6.4 g of anionic surfactant (Newlex R: made by NOF Corporation), and stirred at 280 rpm for 40 minutes. To this were further added 75 g of release agent dispersion solution 1 and 48 g of colorant dispersion solution C1, and the pH thereof was adjusted to 10 by using 1N NaOH aqueous solution. To this was dripped 80 g of 10 wt % magnesium chloride aqueous solution in 10 minutes, and this was then abruptly heated to 56° C. and held at this temperature for 2 hours.

(Formation of Shell Layer)

A mixed dispersion solution, prepared by preliminarily mixing 64 g of crystalline resin 1 dispersion solution and 11 g of PES 1 dispersion solution, was gradually added to the system, and then heated to 85° C., and maintained for one hour. A small amount of the resulting dispersion solution was sampled and separated by a centrifugal separator, and after having confirmed that the supernatant became transparent, 4.8 g of anionic surfactant (Newlex R: made by NOF Corporation) was added thereto at once. Thereafter, this was heated to 94° C. and maintained at this temperature for one hour. This was cooled, washed and dried to obtain toner particles. The toner particles had a particle size of 5.0 μm and a degree of roundness of 0.988.

Example 4-7

(Formation of Core Particles)

To a four-neck flask equipped with a thermometer, a cooling pipe and a stirring device were loaded 475 g of PES 2 dispersion solution, 25 g of urea-modified PES 2 dispersion solution and 6.4 g of anionic surfactant (Newlex R: made by NOF Corporation), and stirred at 280 rpm for 40 minutes. To this were further added 75 g of release agent dispersion solution 1 and 48 g of colorant dispersion solution C1, and the pH thereof was adjusted to 10 by using 1N NaOH aqueous solution. To this was dripped 80 g of 10 wt % magnesium chloride aqueous solution in 10 minutes, and this was then abruptly heated to 56° C. and held at this temperature for 2 hours.

(Formation of Shell Layer)

A mixed dispersion solution, prepared by preliminarily mixing 64 g of crystalline resin 1 dispersion solution and 11 g of urea-modified PES 2 dispersion solution, was gradually added to the system, and then heated to 85° C., and maintained for one hour. A small amount of the resulting dispersion solution was sampled and separated by a centrifugal separator, and after having confirmed that the supernatant became transparent, 4.8 g of anionic surfactant (Newlex R: made by NOF Corporation) was added thereto at once. Thereafter, this was heated to 94° C. and maintained at this temperature for one hour. This was cooled, washed and dried to obtain toner particles. The toner particles had a particle size of 5.4 μm and a degree of roundness of 0.984.

Example 4-8

The same processes as example 4-6 were carried out except that 75 g of crystalline resin 1 dispersion solution was used without using PES 1 dispersion solution, to prepare toner particles. The toner particles had a particle size of 5.8 μm and a degree of roundness of 0.989.

Comparative Example 4-1

To a four-neck flask equipped with a thermometer, a cooling pipe and a stirring device were loaded 75 g of PES 2 dispersion solution, 425 g of crystalline resin 1 dispersion solution and 6.4 g of anionic surfactant (Newlex R: made by NOF Corporation), and stirred at 280 rpm for 40 minutes. To this were further added 75 g of release agent dispersion solution 1 and 48 g of colorant dispersion solution C1, and the pH thereof was adjusted to 10 by using 1N NaOH aqueous solution. To this was dripped 80 g of 10 wt % magnesium chloride aqueous solution in 10 minutes, and this was then abruptly heated to 56° C. and held at this temperature for 2 hours.

To this was added 4.8 g of anionic surfactant (Newlex R: made by NOF Corporation) at once. Thereafter, this was heated to 92° C. and maintained at this temperature for one hour. This was cooled, washed and dried to obtain toner particles. The toner particles had a particle size of 5.8 μm and a degree of roundness of 0.982.

Comparative Example 4-2

To a four-neck flask equipped with a thermometer, a cooling pipe and a stirring device were loaded 450 g of PES 2 dispersion solution, 50 g of urea-modified PES 2 dispersion solution and 6.4 g of anionic surfactant (Newlex R: made by NOF Corporation), and stirred at 280 rpm for 40 minutes. To this were further added 75 g of release agent dispersion solution 1 and 48 g of colorant dispersion solution C1, and the pH thereof was adjusted to 10 by using 1N NaOH aqueous solution. To this was dripped 80 g of 10 wt % magnesium chloride aqueous solution in 10 minutes, and this was then abruptly heated to 56° C. and held at this temperature for 2 hours.

After having gradually added 75 g of PES 1 dispersion solution to the system, this was heated to 85° C. and maintained for one hour. A small amount of the resulting dispersion solution was sampled and separated by a centrifugal separator, and after having confirmed that the supernatant became transparent, 4.8 g of anionic surfactant (Newlex R: made by NOF Corporation) was added thereto at once. Thereafter, this was heated to 94° C. and maintained at this temperature for one hour. This was cooled, washed and dried to obtain toner particles. The toner particles had a particle size of 5.4 μm and a degree of roundness of 0.984.

Comparative Example 4-3

The same processes as example 4-1 were carried out except that 64 g of crystalline resin 1 dispersion solution was changed to 45 g, with 11 g of urea-modified PES 1 dispersion solution being changed to 30 g, to prepare toner particles. The toner particles had a particle size of 5.0 μm and a degree of roundness of 0.988.

Comparative Example 4-4

To a four-neck flask equipped with a thermometer, a cooling pipe and a stirring device were loaded 500 g of PES 2 dispersion solution and 6.4 g of anionic surfactant (Newlex R: made by NOF Corporation), and stirred at 280 rpm for 40 minutes. To this were further added 75 g of release agent dispersion solution 1 and 48 g of colorant dispersion solution C1, and the pH thereof was adjusted to 10 by using 1N NaOH aqueous solution. To this was dripped 80 g of 10 wt % magnesium chloride aqueous solution in 10 minutes, and this was then abruptly heated to 56° C. and held at this temperature for 2 hours. This was temporarily cooled to 50° C.

A mixed dispersion solution, prepared by preliminarily mixing 64 g of crystalline resin 4 dispersion solution and 11 g of urea-modified PES 1 dispersion solution, was gradually added to the system, and maintained, as it was, for one hour. A small amount of the resulting dispersion solution was sampled and separated by a centrifugal separator, and after having confirmed that the supernatant became transparent, 4.8 g of anionic surfactant (Newlex R: made by NOF Corporation) was added thereto at once. Thereafter, this was heated to 55° C. and maintained at this temperature for one hour. This was cooled, washed and dried to obtain toner particles. The toner particles had a particle size of 5.9 μm and a degree of roundness of 0.980.

Comparative Example 4-5

To a four-neck flask equipped with a thermometer, a cooling pipe and a stirring device were loaded 500 g of PES 2 dispersion solution and 6.4 g of anionic surfactant (Newlex R: made by NOF Corporation), and stirred at 280 rpm for 40 minutes. To this were further added 75 g of release agent dispersion solution 1 and 48 g of colorant dispersion solution C1, and the pH thereof was adjusted to 10 by using 1N NaOH aqueous solution. To this was dripped 80 g of 10 wt % magnesium chloride aqueous solution in 10 minutes, and this was then abruptly heated to 56° C. and held at this temperature for 2 hours.

A mixed dispersion solution, prepared by preliminarily mixing 64 g of crystalline resin 5 dispersion solution and 11 g of urea-modified PES 1 dispersion solution, was gradually added to the system, and then heated to 95° C. and maintained, as it was, for one hour. A small amount of the resulting dispersion solution was sampled and separated by a centrifugal separator, and after having confirmed that the supernatant became transparent, 4.8 g of anionic surfactant (Newlex R: made by NOF Corporation) was added thereto at once. This was then maintained for one hour. This was cooled, washed and dried to obtain toner particles. The toner particles had a particle size of 6.2 μm and a degree of roundness of 0.984.

Comparative Example 4-6

To a four-neck flask equipped with a thermometer, a cooling pipe and a stirring device were loaded 350 g of PES 2 dispersion solution, 100 g of crystalline resin 1 dispersion solution, 50 g of urea-modified PES 2 dispersion solution and 6.4 g of anionic surfactant (Newlex R: made by NOF Corporation), and stirred at 280 rpm for 40 minutes. To this were further added 75 g of release agent dispersion solution 1 and 48 g of colorant dispersion solution C1, and the pH thereof was adjusted to 10 by using 1N NaOH aqueous solution. To this was dripped 80 g of 10 wt % magnesium chloride aqueous solution in 10 minutes, and this was then abruptly heated to 56° C. and held at this temperature for 2 hours.

After 75 g of PES 1 dispersion solution had been gradually added to the system, the system was heated to 85° C. and maintained for one hour. A small amount of the resulting dispersion solution was sampled and separated by a centrifugal separator, and after having confirmed that the supernatant became transparent, 4.8 g of anionic surfactant (Newlex R: made by NOF Corporation) was added thereto at once. This was heated to 94° C., and then maintained for one hour. This was cooled, washed and dried to obtain toner particles. The toner particles had a particle size of 5.8 μm and a degree of roundness of 0.980.

TABLE 4-1

| | | Core | | | | | | | | | |
|---|---|---|---|---|---|---|---|---|---|---|---|
| | | Resin A | | | Resin B | | | Wax 1 | | | |
| | | Resin | Softening point (° C.) | Content (weight ratio to total core resin) | Resin | Softening point (° C.) | Content (weight ratio to total core resin) | Kind | Trade name | Softening point (° C.) | Addition amount |
| Example | 4-1 | PES2 | 108 | 100% | — | — | — | Ester wax | WEP-5RF | 82 | 15% |
| | 4-2 | PES2 | 108 | 100% | — | — | — | Ester wax | WEP-5RF | 82 | 15% |
| | 4-3 | PES2 | 108 | 100% | — | — | — | Ester wax | WEP-5RF | 82 | 15% |
| | 4-4 | PES3 | 119 | 100% | — | — | — | Ester wax | WEP-5RF | 82 | 15% |
| | 4-5 | PES2 | 108 | 100% | — | — | — | Ester wax | WE-2 | 60 | 15% |
| | 4-6 | PES2 | 108 | 90% | urea-modified PES2 | 110 | 10% | Ester wax | WEP-5RF | 82 | 15% |
| | 4-7 | PES2 | 108 | 95% | urea-modified PES2 | 110 | 5% | Ester wax | WEP-5RF | 82 | 15% |
| | 4-8 | PES2 | 108 | 90% | urea-modified PES2 | 110 | 10% | Ester wax | WEP-5RF | 82 | 15% |

※The addition amount of release-agent is a weight ratio to resin for core (solids) when added to core.

TABLE 4-2

| | | Shell | | | | |
|---|---|---|---|---|---|---|
| | | Crystalline PES | | | Amorphous resin 1 | |
| | | Resin | Softening point (° C.) | Content (resin ratio for shell, wt %) | Resin | Softening point (° C.) |
| Example | 4-1 | Crystalline resin 1 | 91 | 85% | urea-modified PES1 | 108 |
| | 4-2 | Crystalline resin 1 | 91 | 95% | urea-modified PES1 | 108 |

TABLE 4-2-continued

| | Shell | | | | |
|---|---|---|---|---|---|
| | Crystalline PES | | | Amorphous resin 1 | |
| | Resin | Softening point (° C.) | Content (resin ratio for shell, wt %) | Resin | Softening point (° C.) |
| | 4-3 Crystalline resin 1 | 91 | 72% | urea-modified PES1 | 108 |
| | 4-4 Crystalline resin 2 | 117 | 85% | urea-modified PES1 | 108 |
| | 4-5 Crystalline resin 3 | 64 | 85% | urea-modified PES1 | 108 |
| | 4-6 Crystalline resin 1 | 91 | 85% | PES1 | 105 |
| | 4-7 Crystalline resin 1 | 91 | 85% | urea-modified PES2 | 110 |
| | 4-8 Crystalline resin 1 | 91 | 100% | — | — |

※The addition amount of release-agent is a weight ratio to resin for core (solids) when added to core.

TABLE 4-3

| | Core | | | | | | | | | |
|---|---|---|---|---|---|---|---|---|---|---|
| | Resin A | | | Resin B | | | Wax 1 | | | |
| | Resin | Softening point (° C.) | Content (weight ratio to total core resin) | Resin | Softening point (° C.) | Content (weight ratio to total core resin) | Kind | Trade name | Softening point (° C.) | Addition amount |
| Comparative example | 4-1 PES2 | 108 | 15% | Crystalline resin 1 | 91 | 85% | Ester wax | WEP-5RF | 82 | 15% |
| | 4-2 PES2 | 108 | 90% | urea-modified PES2 | 110 | 10% | Ester wax | WEP-5RF | 82 | 15% |
| | 4-3 PES2 | 108 | 100% | — | — | — | Ester wax | WEP-5RF | 82 | 15% |
| | 4-4 PES2 | 108 | 100% | — | — | — | Ester wax | WEP-5RF | 82 | 15% |
| | 4-5 PES2 | 108 | 100% | — | — | — | Ester wax | WEP-5RF | 82 | 15% |
| | 4-6 PES2 | 108 | 70% | urea-modified PES2 | 110 | 10% | Ester wax | WEP-5RF | 82 | 15% |
| | | | | Crystalline resin 1 | 91 | 20% | | | | |

※The addition amount of release-agent is a weight ratio to resin for core (solids) when added to core.

TABLE 4-4

| | Shell | | | | |
|---|---|---|---|---|---|
| | Crystalline PES | | | Amorphous resin 1 | |
| | Resin | Softening point (° C.) | Content (resin ratio for shell, wt %) | Resin | Softening point (° C.) |
| Comparative example | 4-1 — | — | — | — | — |
| | 4-2 — | — | — | PES1 | 105 |
| | 4-3 Crystalline resin 1 | 91 | 60% | urea-modified PES1 | 108 |
| | 4-4 Crystalline resin 4 | 51 | 85% | urea-modified PES1 | 108 |
| | 4-5 Crystalline resin 5 | 125 | 85% | urea-modified PES1 | 108 |
| | 4-6 — | — | — | PES1 | 105 |

※The addition amount of release-agent is a weight ratio to resin for core (solids) when added to core.

In each of the examples and comparative examples, in addition to the cyan toner particles, magenta toner particles, yellow toner particles and black toner particles were also obtained by carrying out the same processes as the manufacturing method of the cyan toner particles except that magenta colorant dispersion solution M1, yellow colorant dispersion solution Y1 and black colorant dispersion solution K1 were respectively used in place of cyan colorant dispersion solution C1.

(Production of Toner)

To the resulting toner particles were added 0.8% by weight of hydrophobic silica (H2000, 15 nm: made by Hoechst Japan Limited) and 0.4% by weight of hydrophobic titania (STT30A, 30 nm: made by Titan Kogyo K.K.) as external additive agents, and this was mixed by a Henschel mixer so as to carry out addition processes; thus, a toner was obtained.

(Evaluation of Toner)

<Heat-resistant Storing Property>

Cyan toner (20 g) was put into a glass bottle of 50 ml, and after having been left at a high temperature of 55° C. for 12 hours, the toner was visually observed to evaluate the heat resistant storing property.

◎: No aggregating property was observed.

○: There were 1 to 9 softly aggregated toner particles; however, these were easily crumbled with a slight force, causing no problems in practical use.

Δ: There were not less than 10 softly aggregated toner particles; however these were easily crumbled with a slight force, causing no problems in practical use.

x: Firmly aggregated clumps were observed, and hardly crumbled to cause serious problems in practical use.

The toners having four colors, obtained from the respective examples or comparative examples, were loaded into an actual machine, and evaluated. A color laser printer (magicolor 2300 DL; made by Minolta-QMS Co., Ltd.) was used.

<Fixing Property; Non-offset Temperature Width>

The fixing device of the machine is modified so as to desirably set the fixing temperature thereof. By changing the temperature of the fixing roller, a solid image having superposed three colors (Y, M and C) with a total amount of adhesion of 15 g/m$^2$ was outputted with respect to the low-temperature side. A mono-color gradation image with an amount of adhesion of 0 to 5.0 g/m$^2$ was outputted for each of the colors, with respect to the high-temperature side. Thus, each image on paper after passing through the fixing roller was observed. In each of the images, evaluation was made based upon a fixing temperature width (non-offset temperature width) in which neither low-temperature offset nor high-temperature offset occurred. With respect to the paper, CF paper (basis weight 80 g/m$^2$), which is standard paper for use in CF900, was used. Images having even a slight offset were evaluated as "defective."

◎: Non-offset temperature width was not less than 50° C.

○: Non-offset temperature width was not less than 40° C.

Δ: Non-offset temperature width was from not less than 30° C. to less than 40° C.

x: Non-offset temperature width was less than 30° C.

<Low-temperature Fixing Property; Bending Test>

The copied image, fixed on copy paper at 130° C. in the above-mentioned evaluation method of the non-offset temperature width, was folded into two from the middle portion, and the separating property thereof was visually observed.

○: No separation occurred on the image, causing no problems in practical use.

Δ: Although slight separation occurred on the image, no problems were raised in practical use.

x: Many separations occurred on the image, causing problems in practical use.

<Durability (Anti-breaking Property)>

In the evaluation processes, endurance test processes of 2000 sheets of white paper were carried out under L/L environments (10° C., 15%) and the toner to be evaluated was then taken out. The toner particles were observed under a reflection-type electronic microscope at a magnification of ×1000, five times with the viewing field being changed; thus, the average number of broken toner particles was found in 500 toner particles. The evaluation was made based upon the following criteria.

○: No broken toner particles were found, causing no problems in practical use.

Δ: Although 1 to 9 broken toner particles were present, no problems were raised in practical use.

x: Not less than 10 broken toner particles were present, causing problems in practical use.

<Anti-filming Property (Including BS Property)>

Conditions on the photosensitive member and the intermediate transferring member were visually observed respectively after the initial process under L/L environments and after the initial process under N/N environments (23° C., 45%) as well as after continuous copying processes of 2000 sheets (after endurance tests). The continuous copying processes were carried out under a condition of C/W ratio of 6% using a predetermined print pattern.

○: Neither filming nor BS occurred on any of the photosensitive member and the intermediate transferring member.

Δ: Filming and BS occurred on either of the photosensitive member and the intermediate transferring member; however, no adverse effects occurred on the image, causing no problems in practical use.

x: Filming and BS occurred on at least either of the photosensitive member and the intermediate transferring member, and the resulting adverse effects were observed on the image, causing problems in practical use.

<Image Storing Property>

Continuous copying processes for 10 sheets were carried out under a condition of C/W ratio of 6% using a predetermined print pattern. The copying processes were double sided copying processes. Ten sheets of the resulting images were superposed and stored at 50° C. for 24 hours. The conditions after the storage were visually observed and evaluated.

○: No adhered images were found, causing no problems in practical use.

x: Adhered images were found, and image losses occurred when separated, causing problems in practical use.

TABLE 4-5

| | Result of evaluation General | | | | | |
|---|---|---|---|---|---|---|
| | Low-temperature fixing property | Non-offset temperature width | Heat-resistant storing property | Image storing property | Anti-breaking property | Anti-filming |
| Ex. 4-1 | ○ | ◎ | ◎ | ○ | ○ | ○ |
| Ex. 4-2 | ○ | ◎ | ◎ | ○ | ○ | ○ |

TABLE 4-5-continued

| | Result of evaluation General | | | | | |
|---|---|---|---|---|---|---|
| | Low-temperature fixing property | Non-offset temperature width | Heat-resistant storing property | Image storing property | Anti-breaking property | Anti-filming |
| Ex. 4-3 | ○ | ◎ | ◎ | ○ | ○ | ○ |
| Ex. 4-4 | ○ | ◎ | ◎ | ○ | ○ | ○ |
| Ex. 4-5 | ○ | ◎ | ◎ | ○ | ○ | ○ |
| Ex. 4-6 | ○ | ◎ | ○ | ○ | ○ | ○ |
| Ex. 4-7 | ○ | ◎ | ◎ | ○ | ○ | ○ |
| Ex. 4-8 | ○ | ○ | ○ | ○ | ○ | ○ |
| Com. ex. 4-1 | ○ | Δ | X | ○ | X | X |
| Com. ex. 4-2 | X | X | X | ○ | ○ | ○ |
| Com. ex. 4-3 | Δ | X | ○ | ○ | X | X |
| Com. ex. 4-4 | ○ | X | X | X | X | X |
| Com. ex. 4-5 | X | X | ○ | ○ | ○ | ○ |
| Com. ex. 4-6 | X | X | X | ○ | ○ | ○ |

<Measuring Method>

(Release Agent Softening Point)

A differential scanning calorimeter (DSC-200: made by Seiko Instruments Inc.) was used in which: 10 mg of a sample to be measured was precisely weighed, and this was put into an aluminum pan, while alumina was put into an aluminum pan so as to be used as reference, and was heated to 200° C. from normal temperature at a temperature-rise rate of 30° C./min, and this was then cooled, and subjected to measurements in the range of 20° C. to 200° C. at a temperature-rise rate of 10° C./min; thus, the temperature of the main heat-absorption peak was defined as the release agent softening point.

(Particle Size of Toner Particles, Volume-average Particle Size of Core Particles)

The particle size was measured by a Coulter Multisizer II (made by Beckman Coulter, Inc.). In the present invention, the Coulter Multisizer II is used, with an interface used for outputting the grain size distribution (made by Beckman Coulter, Inc.) and a personal computer being connected thereto. With the aperture of the Coulter Multisizer II being set to 50 μm, the volume distribution of the toner having a particle size of not less than 0.99 μm (for example, 2 to 40 μm) was measured, and the grain-size distribution and the average particle size were calculated.

(Measuring Conditions)

(1) Aperture: 50 μm (2) Sample preparation method (in the case of toner particle size): To an electrolytic solution (ISOTON-II-pc (made by Beckman Coulter, Inc.)) (50 to 100 ml) was added a predetermined amount of a surfactant (neutral detergent) and stirred, and to this added 10 to 20 mg of a test sample. The sample was prepared by subjecting this system to a dispersion treatment for one minute by using an ultrasonic dispersing machine. (3) Sample preparation method (in the case of particle size of core particles): An appropriate amount of an associated solution, as it was, was added to an electrolytic solution (ISOTON-II-pc (made by Beckman Coulter, Inc.)) (50 to 100 ml), and prepared as a measuring sample.

(Degree of Roundness of Toner Particles)

Degree of roundness=(circumferential length of a circle obtained based on the diameter equivalent to a circle)/(circumferential length of the projected toner image)

Based upon the above-mentioned equation, measurements were carried out by using a FPIA-1000 (made by Toa Medical Electronics Co., Ltd.)

(Measurements of Particle Sizes of Resin Particles, Pigment Particles and Release Agent Particles)

Measurements were carried out by using a MICROTRAC UPA 150 (made by Nikkiso Co., Ltd.).

What is claimed is:

1. An electrostatic latent-image developing toner comprising:

a core particle and a shell layer formed on an outer portion thereof, wherein the shell layer comprises a crystalline polyester resin having a softening point from 60 to 120° C. at 70 to 100% by weight of the entire shell-layer constituent resin.

2. The toner according to claim 1, wherein the shell layer further comprises an amorphous polyester resin having a softening point from 80 to 130° C.

3. The toner according to claim 1, wherein the resin contained in the core particle is a polyester resin having a softening point from 80 to 130° C.

4. The toner according to claim 1, wherein the shell layer is formed by allowing at least crystalline polyester resin particles to adhere/fuse to the core particle.

5. The toner according to claim 1, wherein the toner particles contain a colorant in a range from 3 to 15% by weight.

6. The toner according to claim 1, wherein an intermediate layer containing a wax is formed between the core particle and the shell layer.

7. The toner according to claim 6, wherein the wax forming the intermediate layer has a softening point that is lower than the softening point of the crystalline polyester resin forming the shell layer.

8. The toner according to claim 6, wherein the crystalline polyester resin forming the shell layer has a softening point that is lower than the softening point of the resin forming the core particle.

9. The toner according to claim 1, wherein the core particle comprises a wax having a polar group and a colorant.

10. The toner according to claim 9, wherein the wax having a polar group comprises a wax having a softening point that is lower than that of the crystalline polyester resin.

11. The toner according to claim 1, wherein the core particle comprises a wax having no polar group.

12. The toner according to claim 1, wherein the toner particle contains a wax in a range from 3 to 50% by weight.

13. The toner according to claim 9, wherein the wax having a polar group has a softening point in a range from 50 to 120° C.

14. The toner according to claim 11, wherein the wax having no polar group is an olefin-based wax having a softening point in a range from 70 to 130° C.

15. The toner according to claim 1, wherein at least one of the core particle and the shell layer contains a urea-modified polyester resin.

16. The toner according to claim 15, wherein the urea-modified polyester resin is contained in the shell layer, with a content thereof being set from 2 to 40% by weight with respect to the entire resin forming the shell layer.

17. The toner according to claim 1, wherein the toner particles have an average degree of roundness from 0.930 to 0.995.

18. An image-forming method, comprising:

forming an electrostatic latent image on a photosensitive member;

forming a toner image by developing the electrostatic latent image on the photosensitive member;

transferring the toner image onto a recording medium; and fixing the toner image on the recording medium, wherein the toner comprises a toner particle prepared by forming a shell layer on the surface of the core particle and the shell layer comprises a crystalline polyester resin having a softening point from 60 to 120° C. at 70 to 100% by weight of the entire shell-layer constituent resin.

19. The image-forming method according to claim 18, wherein simultaneously with a transferring process of the toner image onto the recording medium, a fixing process is carried out.

20. The image-forming method according to claim 19, wherein the transferring process of the toner image onto a recording medium comprises the steps of:

transferring a toner image on the photosensitive member to an intermediate transferring member; and transferring the toner image on the intermediate transferring member to a recording medium, and simultaneously with the transferring process of the toner image from the intermediate transferring member to the recording medium, a fixing process is carried out.

* * * * *